US007406911B2

(12) United States Patent
Uda et al.

(10) Patent No.: US 7,406,911 B2
(45) Date of Patent: Aug. 5, 2008

(54) EXPANDER

(75) Inventors: Makoto Uda, Wako (JP); Hiroyuki Makino, Wako (JP); Kouhei Ohsono, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 639 days.

(21) Appl. No.: 10/469,762

(22) PCT Filed: Mar. 5, 2002

(86) PCT No.: PCT/JP02/01987

§ 371 (c)(1),
(2), (4) Date: Mar. 22, 2004

(87) PCT Pub. No.: WO02/077415

PCT Pub. Date: Oct. 3, 2002

(65) Prior Publication Data

US 2004/0144088 A1 Jul. 29, 2004

(30) Foreign Application Priority Data

Mar. 6, 2001 (JP) ..... 2001-061423

(51) Int. Cl.
*F01B 3/00* (2006.01)

(52) U.S. Cl. ..... 91/499; 91/503; 60/484

(58) Field of Classification Search ..... 91/499, 91/504; 417/269, 375; 60/484, 493
See application file for complete search history.

(56) References Cited

U.S. PATENT DOCUMENTS

| | | | | | |
|---|---|---|---|---|---|
| 1,840,864 | A | * | 1/1932 | Rayburn et al. | 91/499 |
| 2,445,281 | A | | 7/1948 | Rystom | |
| 2,520,632 | A | * | 8/1950 | Greenhut | 91/499 |
| 3,154,983 | A | * | 11/1964 | Firth et al. | 91/499 |
| 3,364,679 | A | * | 1/1968 | Osojnak | 60/465 |
| 3,464,206 | A | | 9/1969 | Badalini | |
| 4,223,594 | A | * | 9/1980 | Gherner | 91/499 |
| 4,478,134 | A | | 10/1984 | Kawahara et al. | |

(Continued)

FOREIGN PATENT DOCUMENTS

DE 1 500 457 7/1969

(Continued)

*Primary Examiner*—Devon Kramer
*Assistant Examiner*—Peter J Bertheaud
(74) *Attorney, Agent, or Firm*—Birch, Stewart, Kolasch & Birch, LLP

(57) ABSTRACT

An expander (M) employing steam as a working medium is formed from a first radially inner group of axial piston cylinders (49) arranged annularly on a rotor (27) so as to surround the axis (L) of an output shaft (28), and a second radially outer group of axial piston cylinders (57) arranged annularly so as to surround the first group of axial piston cylinders (49). The first and second groups of axial piston cylinders (49, 57) are driven by a common swash plate (39), and the first and second groups of axial piston cylinders (49, 57) are arranged with circumferentially displaced pitches. High-temperature, high-pressure steam firstly operates the first group of axial piston cylinders (49), then operates the second group of axial piston cylinders (57), and the outputs from the two are combined to drive the output shaft (28). This achieves a further reduction in the size and a further increase in the output of the axial type expander (M).

3 Claims, 20 Drawing Sheets

U.S. PATENT DOCUMENTS

| | | | | | |
|---|---|---|---|---|---|
| 5,062,267 | A | * | 11/1991 | Stolzer | 60/493 |
| 5,086,689 | A | * | 2/1992 | Masuda | 91/499 |
| 5,230,610 | A | * | 7/1993 | Reichenmiller | 417/269 |
| 6,012,906 | A | * | 1/2000 | Kanamaru | 91/499 |
| 6,283,009 | B1 | * | 9/2001 | Hayashi et al. | 91/499 |

FOREIGN PATENT DOCUMENTS

| | | | |
|---|---|---|---|
| GB | 240107 | | 9/1925 |
| GB | 328 182 | A | 4/1930 |
| GB | 980837 | | 1/1965 |
| JP | 9-4646 | A | 1/1997 |
| JP | 10-47243 | A | 2/1998 |
| JP | 10-184532 | A | 7/1998 |
| JP | 2874300 | B2 | 1/1999 |
| JP | 2000-9024 | A | 1/2000 |
| JP | 2000-320453 | A | 11/2000 |

* cited by examiner

EXPANDER

This application is the national phase under 35 U.S.C. § 371 of PCT International Application No. PCT/JP02/01987 which has an International filing date of Mar. 5, 2002, which designated the United States of America.

FIELD OF THE INVENTION

The present invention relates to an expander that includes a casing, an output shaft for outputting a driving force, a rotor integral with the output shaft and rotatably supported in the casing, a plurality of groups of axial piston cylinders arranged annularly in the rotor along the radial direction so as to surround an axis of the output shaft, and a common swash plate fixed to the casing and guiding pistons of the plurality of groups of axial piston cylinders in the direction of the axis.

BACKGROUND ART

Japanese Patent No. 2874300 and Japanese Utility Model Registration Application Laid-open No. 48-54702 disclose a piston pump or a piston motor that includes two groups of axial piston cylinders arranged on radially inner and outer sides. Either of these employs an incompressible fluid such as oil as the working medium, the groups of axial piston cylinders on the radially inner and outer sides are arranged with their phases displaced circumferentially, and in the former case the piston diameter of the group of axial piston cylinders on the radially inner side is smaller than the piston diameter of the group of axial piston cylinders on the radially outer side.

Furthermore, Japanese Patent Application Laid-open No. 2000-320453 discloses an expander in which a group of axial piston cylinders and a group of vanes are arranged respectively on the radially inner side and the radially outer side of a rotor, and supplying high-temperature, high-pressure steam to the group of vanes via the group of axial piston cylinders converts pressure energy into mechanical energy.

Expanders employing high-temperature, high-pressure steam as the working medium can be divided into a vane type in which a rotor slidably supporting a vane is disposed within a cam ring, a radial type in which a plurality of cylinders and pistons are arranged radially relative to an axis, and an axial type in which a plurality of cylinders and pistons are arranged parallel to an axis.

Although the vane type expander has the advantage that a high steam expansion ratio can be obtained, a long sealing length between the tip of the vane and the inner periphery of the cam ring is required relative to the volume, and since sealing is difficult, there is a large amount of steam leakage, which is a problem.

In the radial type expander, since the cylinders and the pistons are arranged radially relative to the axis, not only does a fan-shaped dead space formed between adjacent cylinders cause an increase in the dimensions, but is also, if a sliding surface of a rotary valve for distributing the steam among the cylinders is cylindrical and a sliding clearance is provided, there is the problem of an increase in the amount of steam leakage compared with a rotary valve having a flat sliding surface.

In contrast, since the axial type expander has its cylinders and pistons arranged in the axial direction, dead space between the cylinders can be made small and the layout on a radial cross section can be made compact, and the dimensions thereof can be made smaller than the radial type expanders where the dead space is large. Furthermore, the amount of steam leaking between the cylinders and the pistons is smaller than the amount of steam leaking between the vane and the cam ring and, moreover, since it is possible to employ a rotary valve having a flat sliding surface and low leakage of steam, a higher output can be achieved compared with the vane type or radial type expanders.

DISCLOSURE OF THE INVENTION

The present invention has been attained in view of the above-mentioned circumstances, and an object thereof is to achieve a further decrease in the dimensions and a further increase in the output of the axial type expander.

In order to achieve this object, in accordance with a first aspect of the present invention, there is proposed an expander that includes a casing, an output shaft for outputting a driving force, a rotor integral with the output shaft and rotatably supported in the casing, a plurality of groups of axial piston cylinders arranged annularly in the rotor along the radial direction so as to surround an axis of the output shaft, and a common swash plate fixed to the casing and guiding pistons of the plurality of groups of axial piston cylinders in the direction of the axis, wherein the more radially outwardly positioned the pistons of the plurality of groups of axial piston cylinders the larger the diameter, and a high-temperature, high-pressure working medium is supplied sequentially from the group of axial piston cylinders on the radially inner side to the group of axial piston cylinders on the radially outer side, the plurality of groups of axial piston cylinders being connected in line.

In accordance with this arrangement, since the plurality of groups of axial piston cylinders are arranged along the radial direction relative to the output shaft and the pistons of each group of axial piston cylinders are all guided by the common swash plate so that a plurality of stages are made to function continuously, not only does the amount of leakage of the working medium decrease compared with the vane type expander, but also the space efficiency of the axial type expander, which has inherently high space efficiency compared with the vane type and radial type expanders, can be further increased, thus providing a small sized, high output expander.

Furthermore, since the more radially outwardly positioned the pistons of the plurality of groups of axially piston cylinders the larger the diameter, and the high-temperature, high-pressure working medium is supplied sequentially from the group of axial piston cylinders on the radially inner side to the group of axial piston cylinders on the radially outer side, which are connected in line, not only can the dead space be minimized and the dimensions of the expander reduced, but also since a small-volume, high-pressure working medium acts on the group of axial piston cylinders on the radially inner side, which have a small diameter, and a large-volume, low-pressure working medium acts on the group of axial piston cylinders on the radially outer side, which have a large diameter, pressure energy of the working medium can be converted into mechanical energy without loss. Moreover, the area of the sliding parts of the group of axial piston cylinders on the radially inner side, where a high-pressure working medium acts and leakage easily occurs, can be minimized, thereby further suppressing leakage of the working medium.

Moreover, since the high-temperature working medium prior to expansion acts on the group of axial piston cylinders on the radially inner side, and the low-temperature working medium subsequent to expansion acts on the group of axial piston cylinders on the radially outer side, the heat dissipated from the group of axial piston cylinders on the radially inner side, on which the high-temperature working medium acts, can be recovered by the group of axial piston cylinders on the radially outer side, on which the low-temperature working medium acts, thereby decreasing any loss of thermal energy.

Furthermore, in accordance with a second aspect of the present invention, in addition to the first aspect, there is proposed an expander wherein the pitches at which radially adjacent groups of axial piston cylinders are arranged are displaced circumferentially.

In accordance with this arrangement, since the pitches at which the radially adjacent groups of axial piston cylinders are arranged are displaced circumferentially, not only can the external dimensions of the expander be further reduced by arranging the cylinders on the radially inner side in spaces between the cylinders on the radially outer side, but also variation in output torque of the plurality of groups of axial piston cylinders can be reduced.

Moreover, in accordance with a third aspect of the present invention, in addition to the first or second aspect, there is proposed an expander wherein a working medium supply/discharge part formed from an intake/exhaust valve for supplying and discharging the working medium to and from the plurality of groups of axial piston cylinders, a power conversion part formed from the rotor, and an output part formed from the output shaft and the swash plate are arranged sequentially from one end of the axis to the other end thereof.

In accordance with this arrangement, since the working medium supply/discharge part and the output part are disposed in separated positions on either side of the power conversion part, oil lubricating a sliding section of the output part can be prevented from deteriorating due to heat from the working medium supply/discharge part through which high-temperature working medium passes, thereby maintaining the lubricating performance of the output part.

A rotary valve 61 of embodiments corresponds to the intake/exhaust valve of the present invention.

BRIEF DESCRIPTION OF DRAWINGS

FIG. 1 is a vertical sectional view of an expander; FIG. 2 is a sectional view along line 2-2 in FIG. 1; FIG. 3 is an enlarged view of part 3 in FIG. 1; FIG. 4 is an enlarged sectional view of part 4 in FIG. 1 (sectional view along line 4-4 in FIG. 8); FIG. 5 is a view from arrowed line 5-5 in FIG. 4; FIG. 6 is a view from arrowed line 6-6 in FIG. 4; FIG. 7 is a sectional view along line 7-7 in FIG. 4; FIG. 8 is a sectional view along line 8-8 in FIG. 4; FIG. 9 is a sectional view along line 9-9 in FIG. 4; FIG. 10 is a view from arrowed line 10-10 in FIG. 1; FIG. 11 is a view from arrowed line 11-11 in FIG. 1; FIG. 12 is a sectional view along line 12-12 in FIG. 10; FIG. 13 is a sectional view along line 13-13 in FIG. 11; FIG. 14 is a sectional view along line 14-14 in FIG. 10; FIG. 15 is a graph showing torque variations of an output shaft; FIG. 16 is an explanatory diagram showing the operation of an intake system of a high-pressure stage; FIG. 17 is an explanatory diagram showing the operation of a discharge system of the high-pressure stage and an intake system of a low-pressure stage; and FIG. 18 is an explanatory diagram showing the operation of a discharge system of the low-pressure stage.

BEST MODE FOR CARRYING OUT THE INVENTION

The first embodiment of the present invention is explained below by reference to FIG. 1 to FIG. 18.

Figure 1:
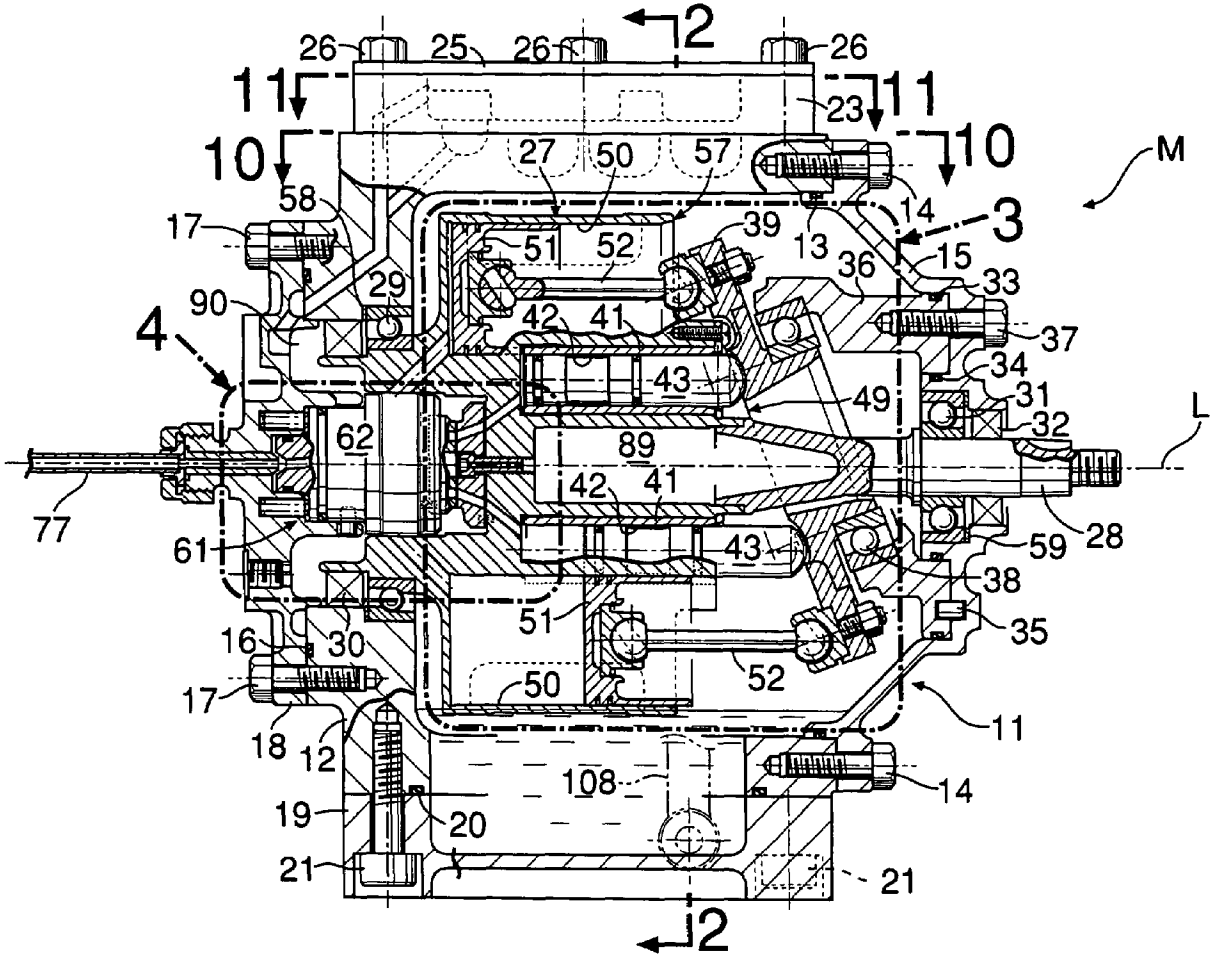
FIG. 1 to FIG. 18 illustrate a first embodiment of the present invention.
Figure 2:
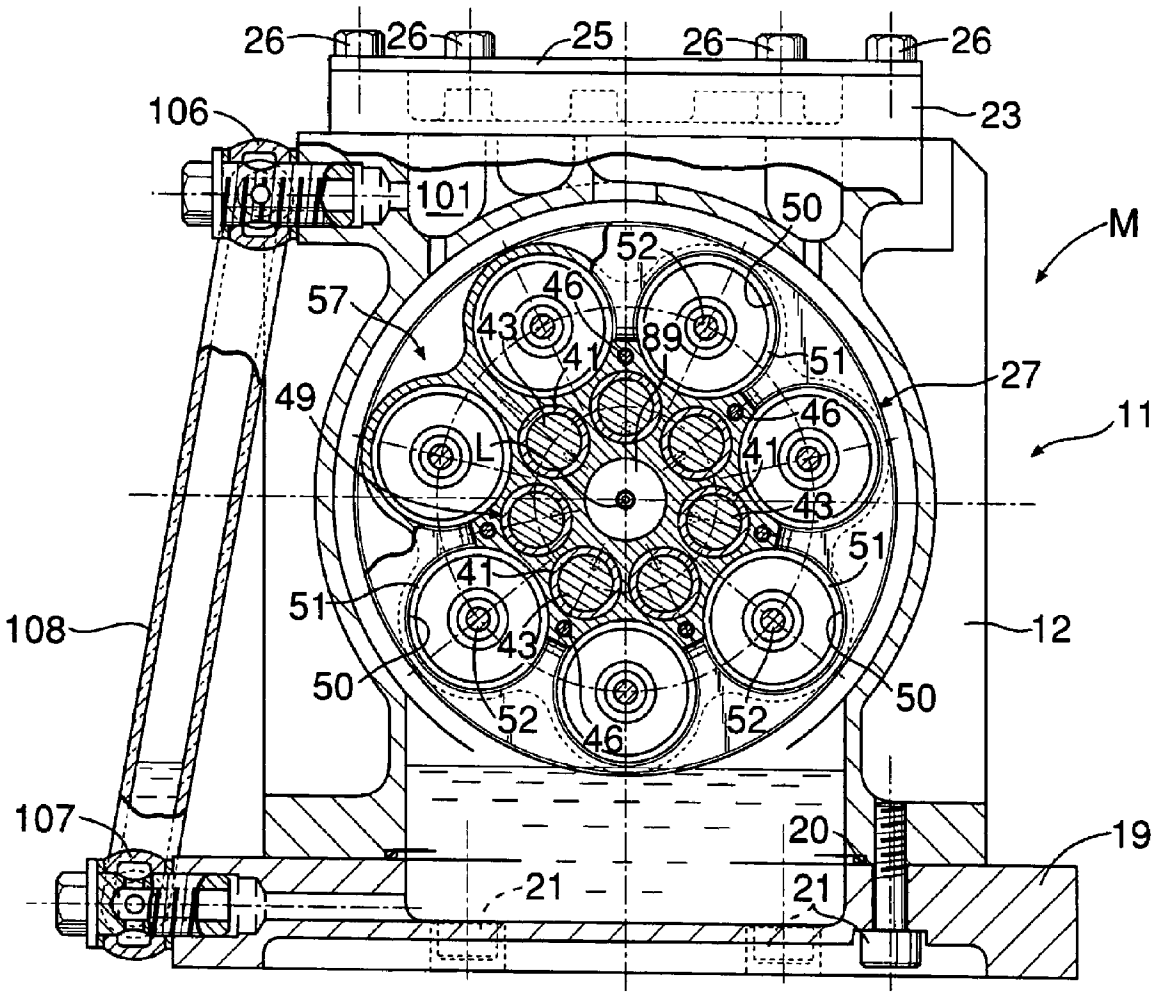
Figure 3:
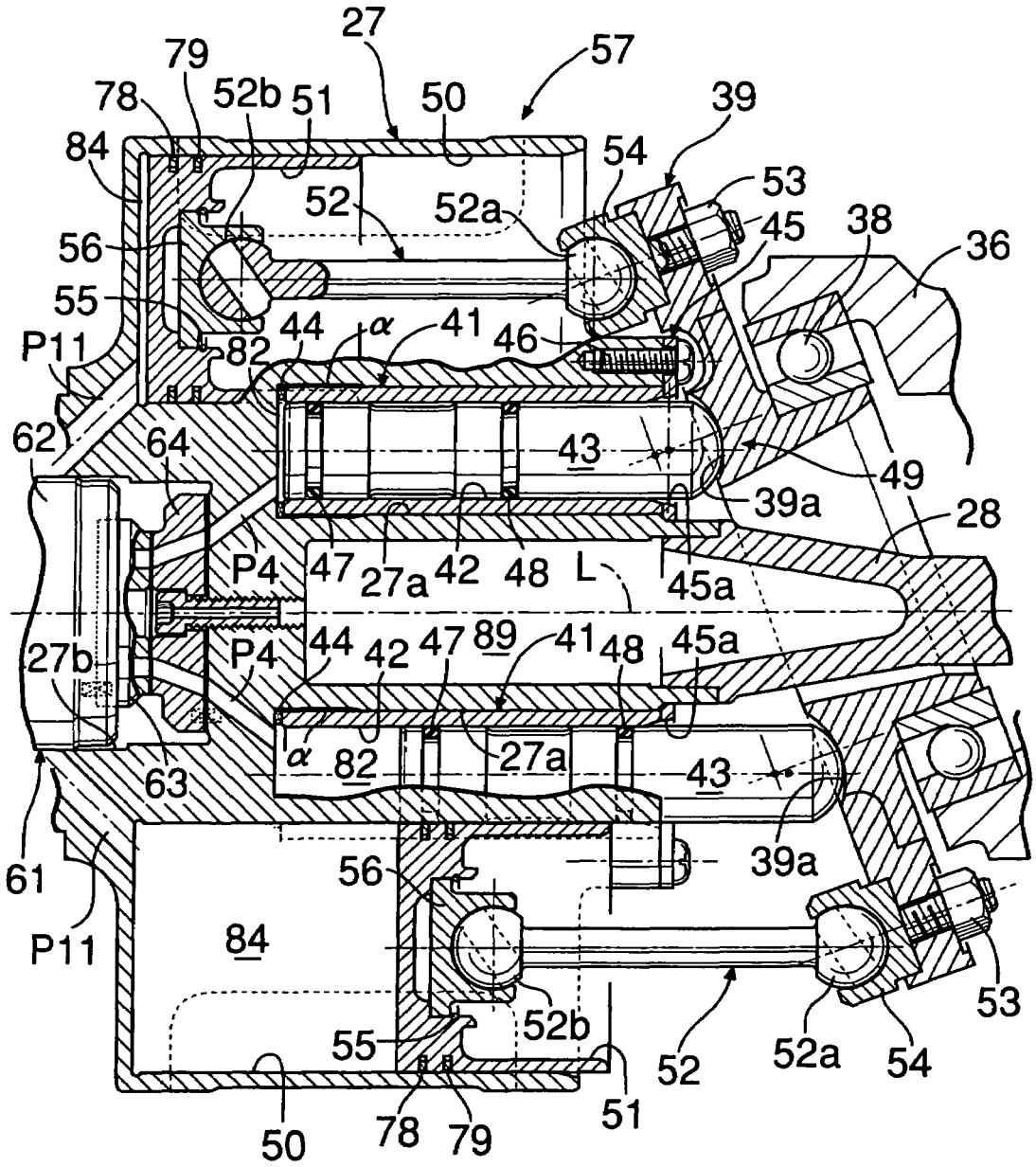

As shown in FIG. 1 to FIG. 3, an expander M of the present embodiment is used in, for example, a Rankine cycle system, and the thermal energy and the pressure energy of high-temperature, high-pressure steam as a working medium are converted into mechanical energy and output. A casing 11 of the expander M is formed from a casing main body 12, a front cover 15 fitted via a seal 13 in a front opening of the casing main body 12 and joined thereto via a plurality of bolts 14, and a rear cover 18 fitted via a seal 16 in a rear opening of the casing main body 12 and joined thereto via a plurality of bolts 17. An oil pan 19 abuts against a lower opening of the casing main body 12 via a seal 20 and is joined thereto via a plurality of bolts 21. Furthermore, a breather chamber dividing wall 23 is superimposed on an upper surface of the casing main body 12 via a seal 22 (see FIG. 12), a breather chamber cover 25 is further superimposed on an upper surface of the breather chamber dividing wall 23 via a seal 24 (see FIG. 12), and they are together secured to the casing main body 12 by means of a plurality of bolts 26.

A rotor 27 and an output shaft 28 that can rotate around an axis L extending in the fore-and-aft direction in the center of the casing 11 are united by welding. A rear part of the rotor 27 is rotatably supported in the casing main body 12 via an angular ball bearing 29 and a seal 30, and a front part of the output shaft 28 is rotatably supported in the front cover 15 via an angular ball bearing 31 and a seal 32. A swash plate holder 36 is fitted via two seals 33 and 34 and a knock pin 35 in a rear face of the front cover 15 and fixed thereto via a plurality of bolts 37, and a swash plate 39 is rotatably supported in the swash plate holder 36 via an angular ball bearing 38. The rotational axis of the swash plate 39 is inclined relative to the axis L of the rotor 27 and the output shaft 28, and the angle of inclination is fixed.

Seven sleeves 41 formed from members that are separate from the rotor 27 are arranged within the rotor 27 so as to surround the axis L at equal intervals in the circumferential direction. High-pressure pistons 43 are slidably fitted in high-pressure cylinders 42 formed at inner peripheries of the sleeves 41, which are supported by sleeve support bores **27*a* of the rotor 27. Hemispherical parts of the high-pressure pistons 43 projecting forward from forward end openings of the high-pressure cylinders 42 abut against and press against seven dimples 39*a* recessed in a rear surface of the swash plate 39. Heat resistant metal seals 44 are fitted between the rear ends of the sleeves 41 and the sleeve support bores 27*a* of the rotor 27, and a single set plate 45 retaining the front ends of the sleeves 41 in this state is fixed to a front surface of the rotor 27 by means of a plurality of bolts 46. The sleeve support bores 27*a* have a slightly larger diameter in the vicinity of their bases, thus forming a gap a (see FIG. 3) between themselves and the outer peripheries of the sleeves 41**.

The high-pressure pistons 43 include pressure rings 47 and oil rings 48 for sealing the sliding surfaces with the high-pressure cylinders 42, and the sliding range of the pressure rings 47 and the sliding range of the oil rings 48 are set so as not to overlap each other. When the high-pressure pistons 43 are inserted into the high-pressure cylinders 42, in order to make the pressure rings 47 and the oil rings 48 engage smoothly with the high-pressure cylinders 42, tapered openings **45*a* widening toward the front are formed in the set plate 45**.

As hereinbefore described, since the sliding range of the pressure rings 47 and the sliding range of the oil rings 48 are set so as not to overlap each other, oil attached to the inner walls of the high-pressure cylinders 42 against which the oil rings 48 slide will not be taken into high-pressure operating chambers 82 due to sliding of the pressure rings 47, thereby reliably preventing the oil from contaminating the steam. In particular, the high-pressure pistons 43 have a slightly smaller diameter part between the pressure rings 47 and the oil rings 48 (see FIG. 3), thereby effectively preventing the oil attached to the sliding surfaces of the oil rings 48 from moving to the sliding surfaces of the pressure rings 47.

Since the high-pressure cylinders 42 are formed by fitting the seven sleeves 41 in the sleeve support bores 27*a* of the rotor 27, a material having excellent thermal conductivity, heat resistance, abrasion resistance, strength, etc. can be selected for the sleeves 41. This not only improves the performance and the reliability, but also machining becomes easy compared with a case in which the high-pressure cylinders 42 are directly machined in the rotor 27, and the machining precision also increases. When any one of the sleeves 41 is worn or damaged, it is possible to exchange only the sleeve 41 with an abnormality, without exchanging the entire rotor 27, and this is economical.

Furthermore, since the gap a is formed between the outer periphery of the sleeves 41 and the rotor 27 by slightly enlarging the diameter of the sleeve support bores 27*a* in the vicinity of the base, even when the rotor 27 is thermally deformed by the high-temperature, high-pressure steam supplied to the high-pressure operating chambers 82, this is prevented from affecting the sleeves 41, thereby preventing the high-pressure cylinders 42 from distorting.

The seven high-pressure cylinders 42 and the seven high-pressure pistons 43 fitted therein form a first group of axial piston cylinders 49.

Seven low-pressure cylinders 50 are arranged at circumferentially equal intervals on the outer peripheral part of the rotor 27 so as to surround the axis L and the radially outer side of the high-pressure cylinders 42. These low-pressure cylinders 50 have a larger diameter than that of the high-pressure cylinders 42, and the pitch at which the low-pressure cylinders 50 are arranged in the circumferential direction is displaced by half a pitch relative to the pitch at which the high-pressure cylinders 42 are arranged in the circumferential direction. This makes it possible for the high-pressure cylinders 42 to be arranged in spaces formed between adjacent low-pressure cylinders 50, thus utilizing the spaces effectively and contributing to a reduction in the diameter of the rotor 27.

The seven low-pressure cylinders 50 have low-pressure pistons 51 slidably fitted thereinto, and these low-pressure pistons 51 are connected to the swash plate 39 via links 52. That is, spherical parts 52*a* at the front end of the links 52 are swingably supported in spherical bearings 54 fixed to the swash plate 39 via nuts 53, and spherical parts 52*b* at the rear end of the links 52 are swingably supported in spherical bearings 56 fixed to the low-pressure pistons 51 by clips 55. A pressure ring 78 and an oil ring 79 are fitted around the outer periphery of each of the low-pressure pistons 51 in the vicinity of the top surface thereof so as to adjoin each other. Since the sliding ranges of the pressure ring 78 and the oil ring 79 overlap each other, an oil film is formed on the sliding surface of the pressure ring 78, thus enhancing the sealing characteristics and the lubrication.

The seven low-pressure cylinders 50 and the seven low-pressure pistons 51 fitted therein form a second group of axial piston cylinders 57.

As hereinbefore described, since the front ends of the high-pressure pistons 43 of the first group of axial piston cylinders 49 are made in the form of hemispheres and are made to abut against the dimples 39*a* formed in the swash plate 39, it is unnecessary to connect the high-pressure pistons 43 to the swash plate 39 mechanically, thus reducing the number of parts and improving the ease of assembly. On the other hand, the low-pressure pistons 51 of the second group of axial piston cylinders 57 are connected to the swash plate 39 via the links 52 and their front and rear spherical bearings 54 and 56, and even when the temperature and the pressure of medium-temperature, medium-pressure steam supplied to the second group of axial piston cylinders 57 become insufficient and the pressure of low-pressure operating chambers 84 becomes negative, there is no possibility of the low-pressure pistons 51 becoming detached from the swash plate 39 and causing knocking or damage.

Furthermore, when the swash plate 39 is secured to the front cover 15 via the bolts 37, changing the phase at which the swash plate 39 is secured around the axis L enables the timing of supply and discharge of the steam to and from the first group of axial piston cylinders 49 and the second group of axial piston cylinders 57 to be shifted, thereby altering the output characteristics of the expander M.

Moreover, since the rotor 27 and the output shaft 28, which are united, are supported respectively by the angular ball bearing 29 provided on the casing main body 12 and the angular ball bearing 31 provided on the front cover 15, by adjusting the thickness of a shim 58 disposed between the casing main body 12 and the angular ball bearing 29 and the thickness of a shim 59 disposed between the front cover 15 and the angular ball bearing 31, the longitudinal position of the rotor 27 along the axis L can be adjusted. By adjusting the position of the rotor 27 in the axis L direction, the relative positional relationship in the axis L direction between the high-pressure and low-pressure pistons 43 and 51 guided by the swash plate 39, and the high-pressure and low-pressure cylinders 42 and 50 provided in the rotor 27 can be changed, thereby adjusting the expansion ratio of the steam in the high-pressure and low-pressure operating chambers 82 and 84.

If the swash plate holder 36 supporting the swash plate 39 were formed integrally with the front cover 15, it would be difficult to secure a space for attaching and detaching the angular ball bearing 31 or the shim 59 to and from the front cover 15, but since the swash plate holder 36 is made detachable from the front cover 15, the above-mentioned problem can be eliminated. Moreover, if the swash plate holder 36 were integral with the front cover 15, during assembly and disassembly of the expander M it would be necessary to carry out cumbersome operations of connecting and disconnecting the seven links 52, which are in a confined space within the casing 11, to and from the swash plate 39 pre-assembled to the front cover 15, but since the swash plate holder 36 is made detachable from the front cover 15, it becomes possible to form a sub-assembly by assembling the swash plate 39 and the swash plate holder 36 to the rotor 27 in advance, thereby greatly improving the ease of assembly.

Systems for supply and discharge of steam to and from the first group of axial piston cylinders 49 and the second group of axial piston cylinders 57 are now explained by reference to FIG. 4 to FIG. 9.

Figure 4:
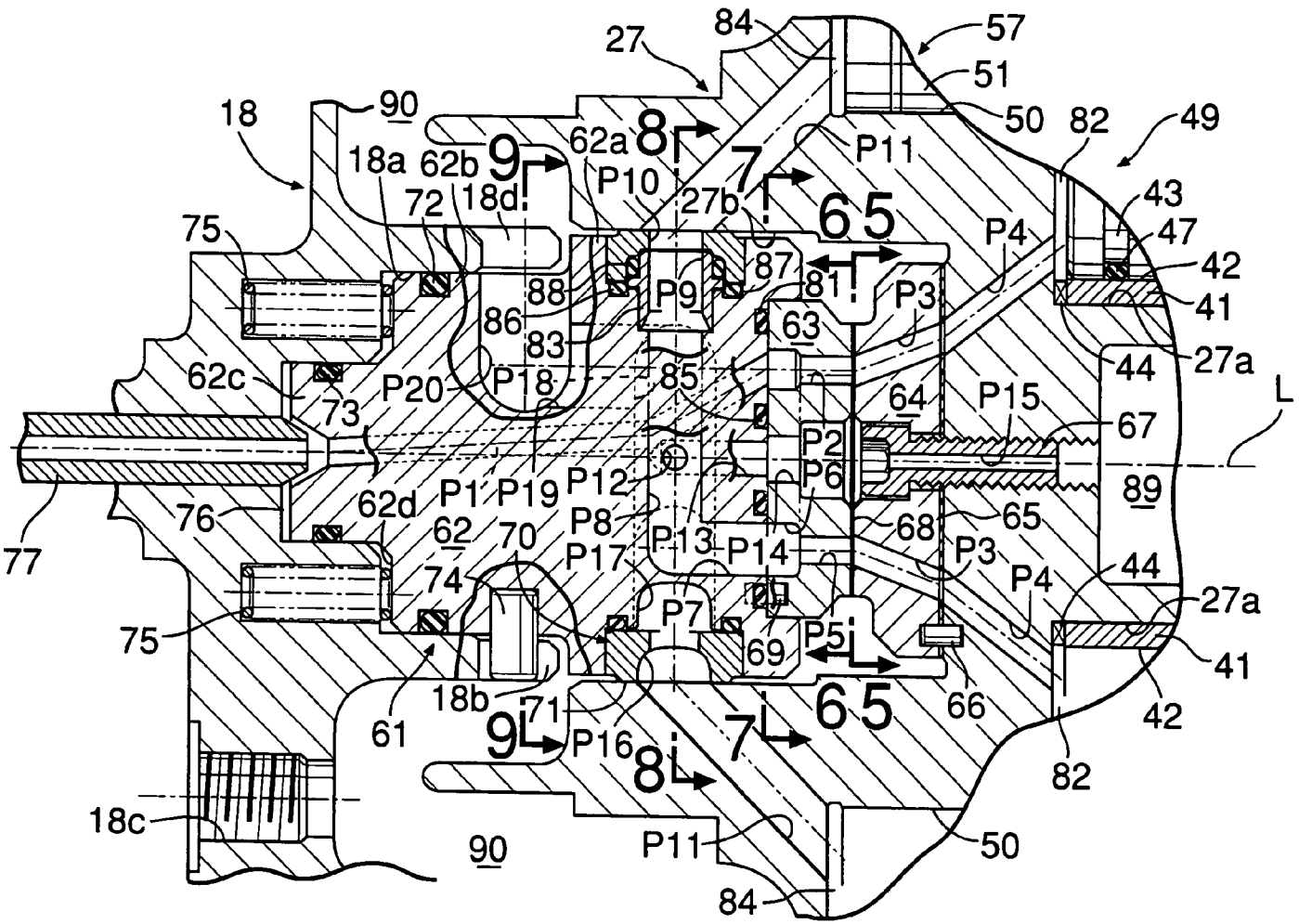
Figure 5:
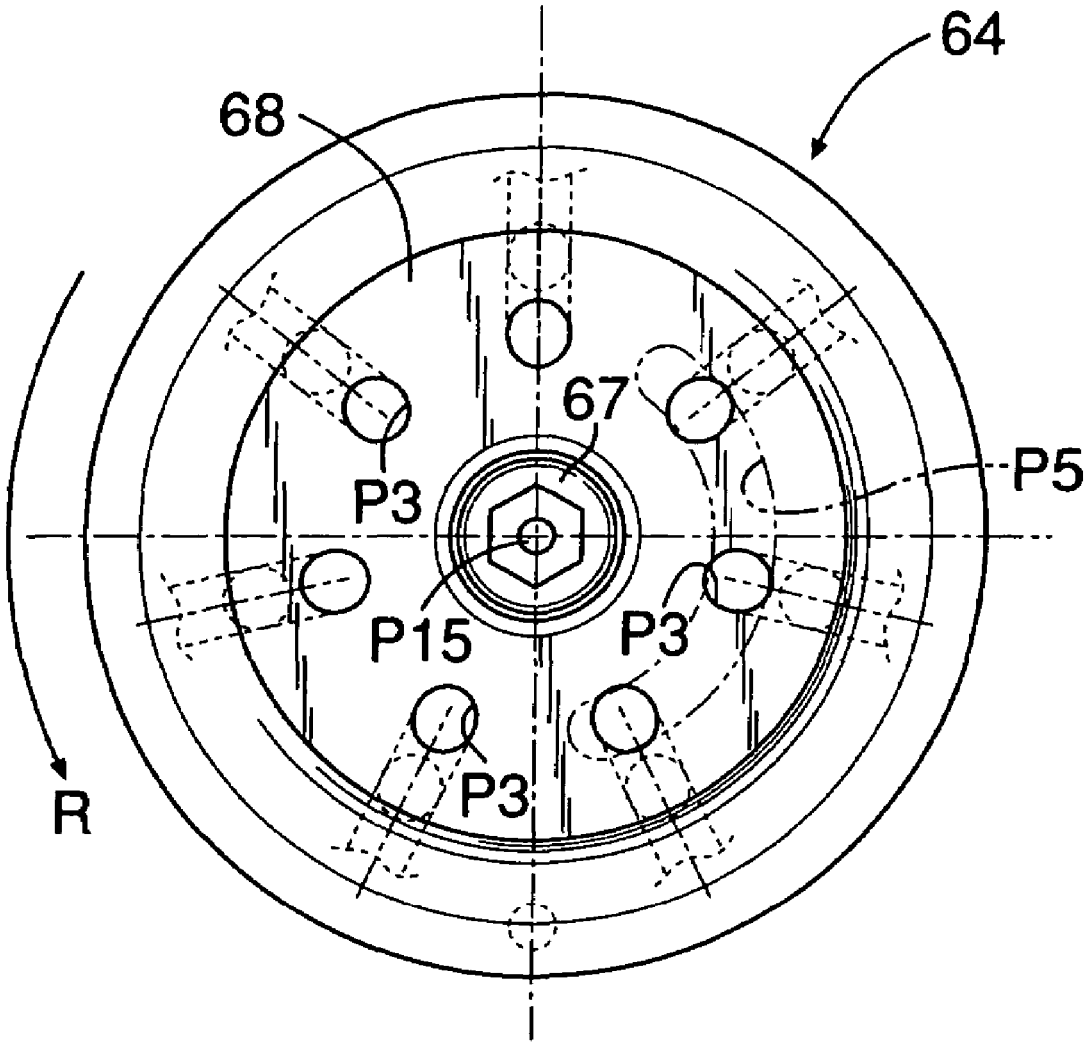

As shown in FIG. 4, a rotary valve 61 is housed in a circular cross-section recess 27*b* opening on the rear end surface of the rotor 27 and a circular cross-section recess 18*a* opening on a front surface of the rear cover 18. The rotary valve 61, which is disposed along the axis L, includes a rotary valve main body 62, a stationary valve plate 63, and a movable valve plate 64. The movable valve plate 64 is fixed to the rotor 27 via a knock pin 66 and a bolt 67 while being fitted to the base of the recess 27*b* of the rotor 27 via a gasket 65. The stationary valve plate 63, which abuts against the movable valve plate 64 via a flat sliding surface 68, is joined via a knock pin 69 to the rotary valve main body 62 so that there is no relative rotation therebetween. When the rotor 27 rotates, the movable valve plate 64 and the stationary valve plate 63 therefore rotate relative to each other on the sliding surface 68 in a state in which they are in intimate contact with each other. The stationary valve plate 63 and the movable valve plate 64 are made of a material having excellent durability, such as a super hard alloy or a ceramic, and the sliding surface 68 can be provided with or coated with a member having heat resistance; lubrication, corrosion resistance, and abrasion resistance.

The rotary valve main body 62 is a stepped cylindrical member having a large diameter part 62*a*, a medium diameter part 62*b*, and a small diameter part 62*c*; an annular sliding member 70 fitted around the outer periphery of the large diameter part 62*a* is slidably fitted in the recess 27*b* of the rotor 27 via a cylindrical sliding surface 71, and the medium diameter part 62*b* and the small diameter part 62*c* are fitted in the recess 18*a* of the rear cover 18 via seals 72 and 73. The sliding member 70 is made of a material having excellent durability, such as a super hard alloy or a ceramic. A knock pin 74 implanted in the outer periphery of the rotary valve main body 62 engages with a long hole 18*b* formed in the recess 18*a* of the rear cover 18 in the axis L direction, and the rotary valve main body 62 is therefore supported so that it can move in the axis L direction but cannot rotate relative to the rear cover 18.

A plurality of (for example, seven) preload springs 75 are supported in the rear cover 18 so as to surround the axis L, and the rotary valve main body 62, which has a step 62*d* between the medium diameter part 62*b* and the small diameter part 62*c* pressed by these preload springs 75, is biased forward so as to make the sliding surface 68 of the stationary valve plate 63 and the movable valve plate 64 come into intimate contact with each other. A pressure chamber 76 is defined between the bottom of the recess 18*a* of the rear cover 18 and the rear end surface of the small diameter part 62*c* of the rotary valve main body 62, and a steam supply pipe 77 connected so as to run though the rear cover 18 communicates with the pressure chamber 76. The rotary valve main body 62 is therefore biased forward by the steam pressure acting on the pressure chamber 76 in addition to the resilient force of the preload springs 75.

Figure 16:
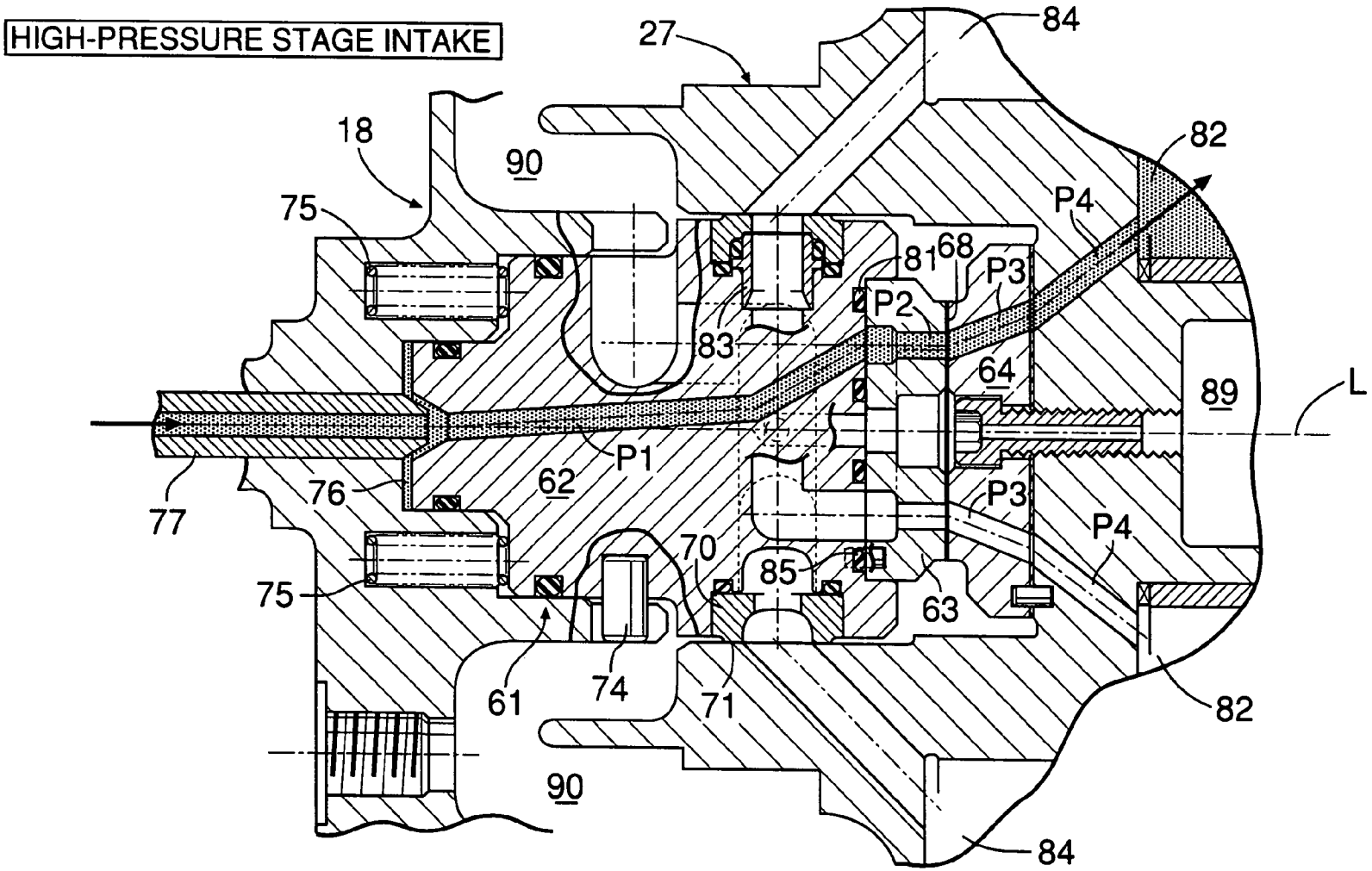

A high-pressure stage steam intake route for supplying high-temperature, high-pressure steam to the first group of axial piston cylinders 49 is shown in FIG. 16 by a mesh pattern. As is clear from FIG. 16 together with FIG. 5 to FIG. 9, a first steam passage P1 having its upstream end communicating with the pressure chamber 76, to which the high-temperature, high-pressure steam is supplied from the steam supply pipe 77, runs through the rotary valve main body 62, opens on the surface at which the rotary valve main body 62 is joined to the stationary valve plate 63, and communicates with a second steam passage P2 running through the stationary valve plate 63. In order to prevent the steam from leaking past the surface at which the rotary valve main body 62 and the stationary valve plate 63 are joined, the joining surface is equipped with a seal 81 (see FIG. 7 and FIG. 16), which seals the outer periphery of a connecting part between the first and second steam passages P1 and P2.

Seven third steam passages P3 (see FIG. 5) and seven fourth steam passages P4 are formed respectively in the movable valve plate 64 and the rotor 27 at circumferentially equal intervals, and the downstream ends of the fourth steam passages P4 communicate with the seven high-pressure operating chambers 82 defined between the high-pressure cylinders 42 and the high-pressure pistons 43 of the first group of axial piston cylinders 49. As is clear from FIG. 6, an opening of the second steam passage P2 formed in the stationary valve plate 63 does not open evenly to the front and rear of the top dead center (TDC) of the high-pressure pistons 43, but opens displaced slightly forward in the direction of rotation of the rotor 27, which is shown by the arrow R. This enables as long an expansion period as possible, that is, a sufficient expansion ratio, to be maintained, negative work, which would be generated if the opening were set evenly to the front and rear of the TDC, to be minimized and, moreover, the expanded steam remaining in the high-pressure operating chambers 82 to be reduced, thus providing sufficient output (efficiency).

Figure 17:
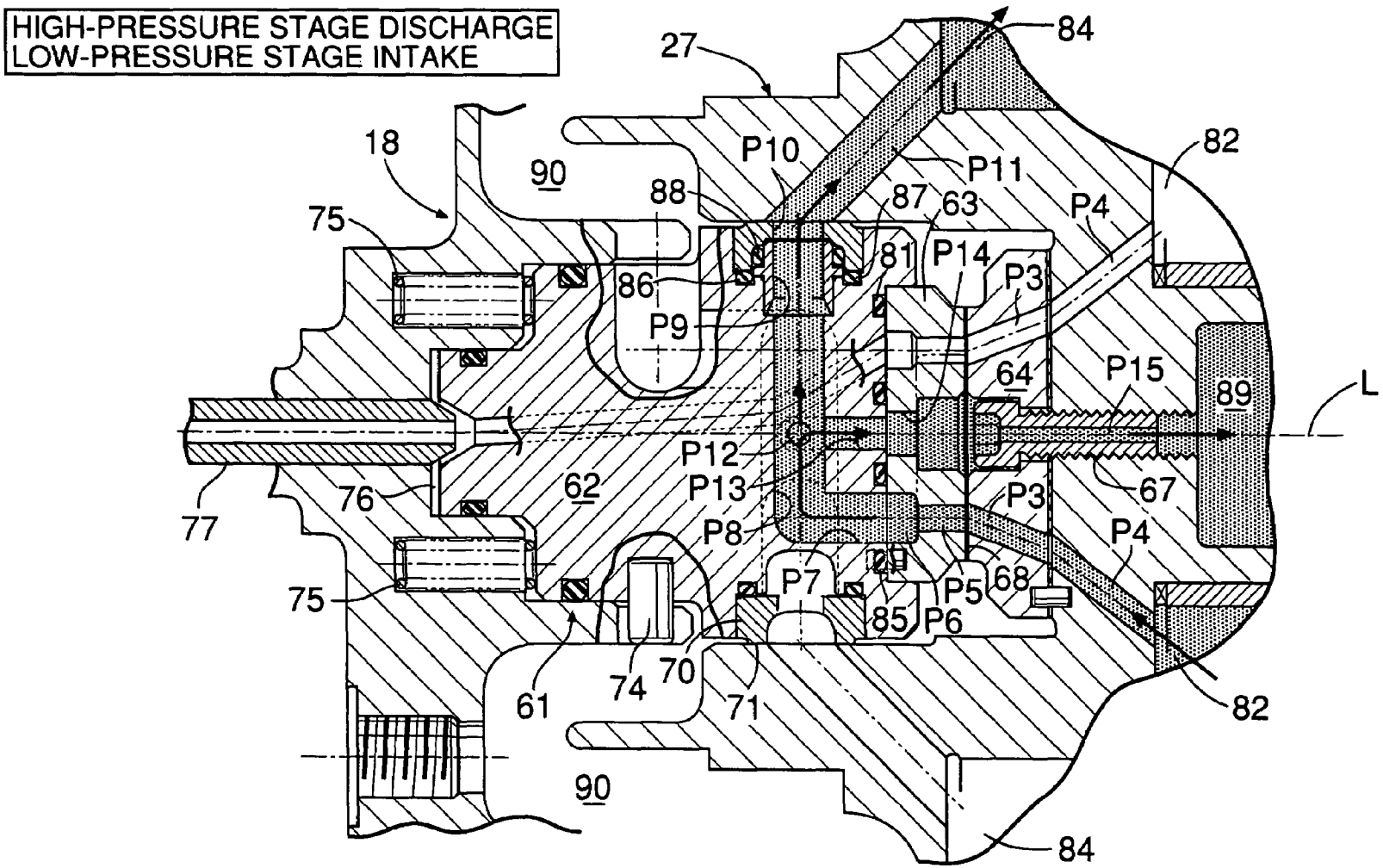

A high-pressure stage steam discharge route and a low-pressure stage steam intake route for discharging medium-temperature, medium-pressure steam from the first group of axial piston cylinders 49 and supplying it to the second group of axial piston cylinders 57 are shown in FIG. 17 by a mesh pattern. As is clear from FIG. 17 together with FIG. 5 to FIG. 8, an arc-shaped fifth steam passage P5 (see FIG. 6) opens on a front surface of the stationary valve plate 63, and this fifth steam passage P5 communicates with a circular sixth steam passage P6 opening on a rear surface of the stationary valve plate 63 (see FIG. 7). The fifth steam passage P5 opens from a position displaced slightly forward in the direction of rotation of the rotor 27, which is shown by the arrow R, relative to the bottom dead center (BDC) of the high-pressure pistons 43 to a position slightly displaced backward in the rotational direction relative to the TDC. This enables the third steam passages P3 of the movable valve plate 64 to communicate with the fifth steam passage P5 of the stationary valve plate 63 over an angular range that starts from the BDC and does not overlap the second steam passage P2 (preferably, immediately before overlapping the second steam passage P2), and in this range the steam is discharged from the third steam passages P3 to the fifth steam passage P5.

Formed in the rotary valve main body 62 are a seventh steam passage P7 extending in the axis L direction and an eighth steam passage P8 extending in a substantially radial direction. The upstream end of the seventh steam passage P7 communicates with the downstream end of the sixth steam passage P6. The downstream end of the eighth steam passage P8 communicates with a tenth steam passage P10 running radially through the sliding member 70 via a ninth steam passage P9 within a coupling member 83 disposed so as to bridge between the rotary valve main body 62 and the sliding member 70. The tenth steam passage P10 communicates with the seven low-pressure operating chambers 84 defined between the low-pressure cylinders 50 and the low-pressure pistons 44 of the second group of axial piston cylinders 57 via seven eleventh steam passages P11 formed radially in the rotor 27.

Figure 7:
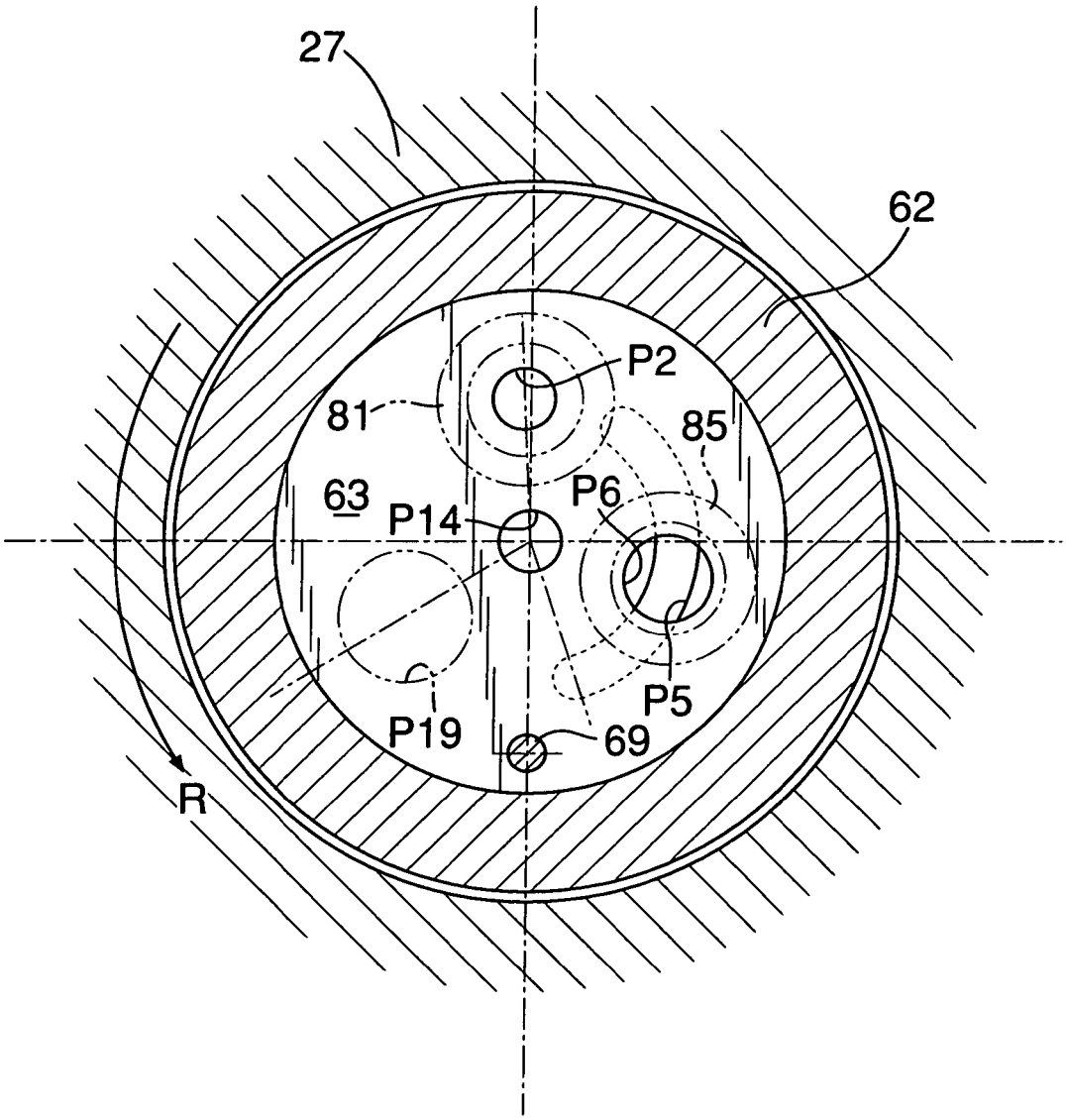
Figure 8:
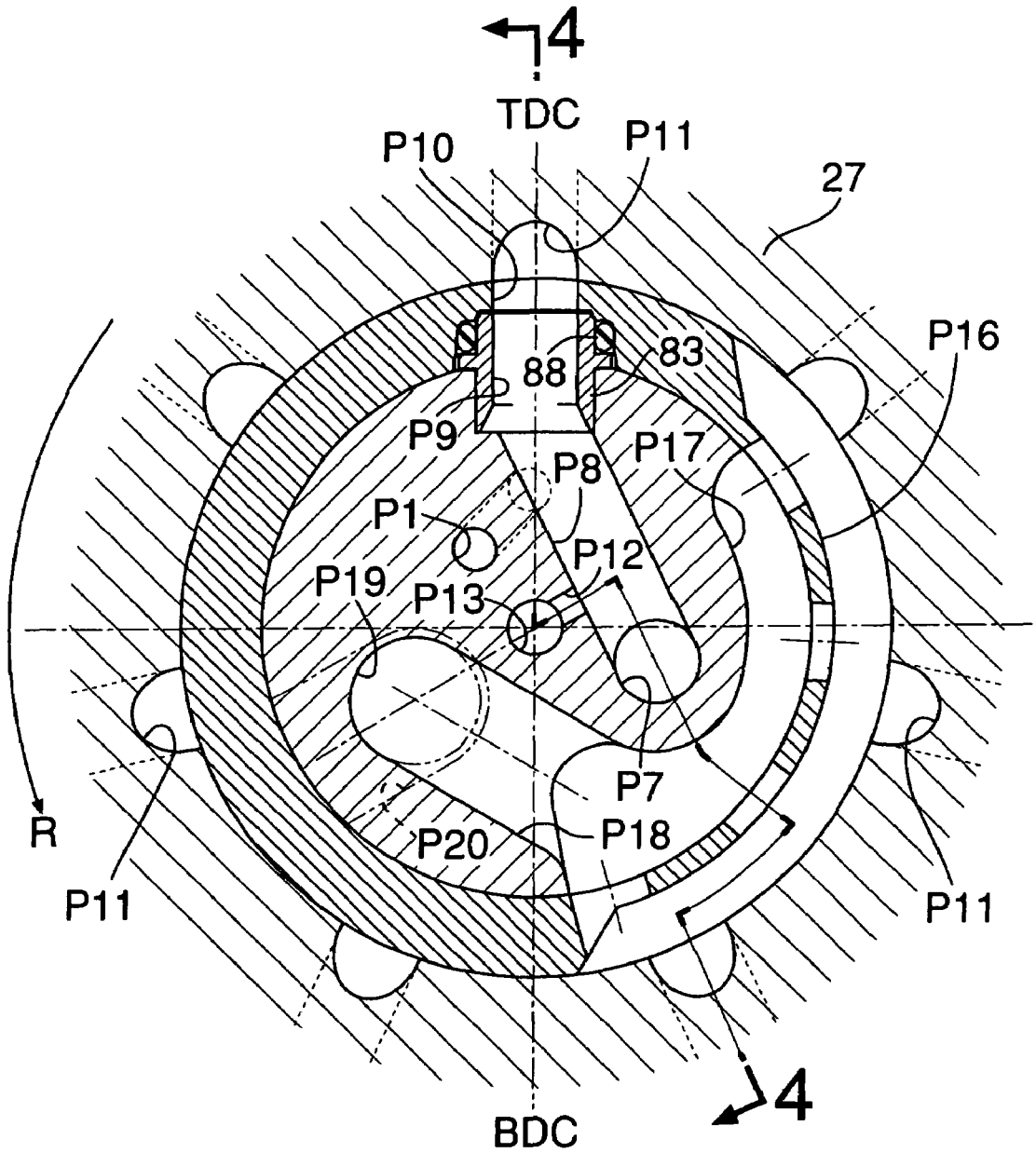
Figure 9:
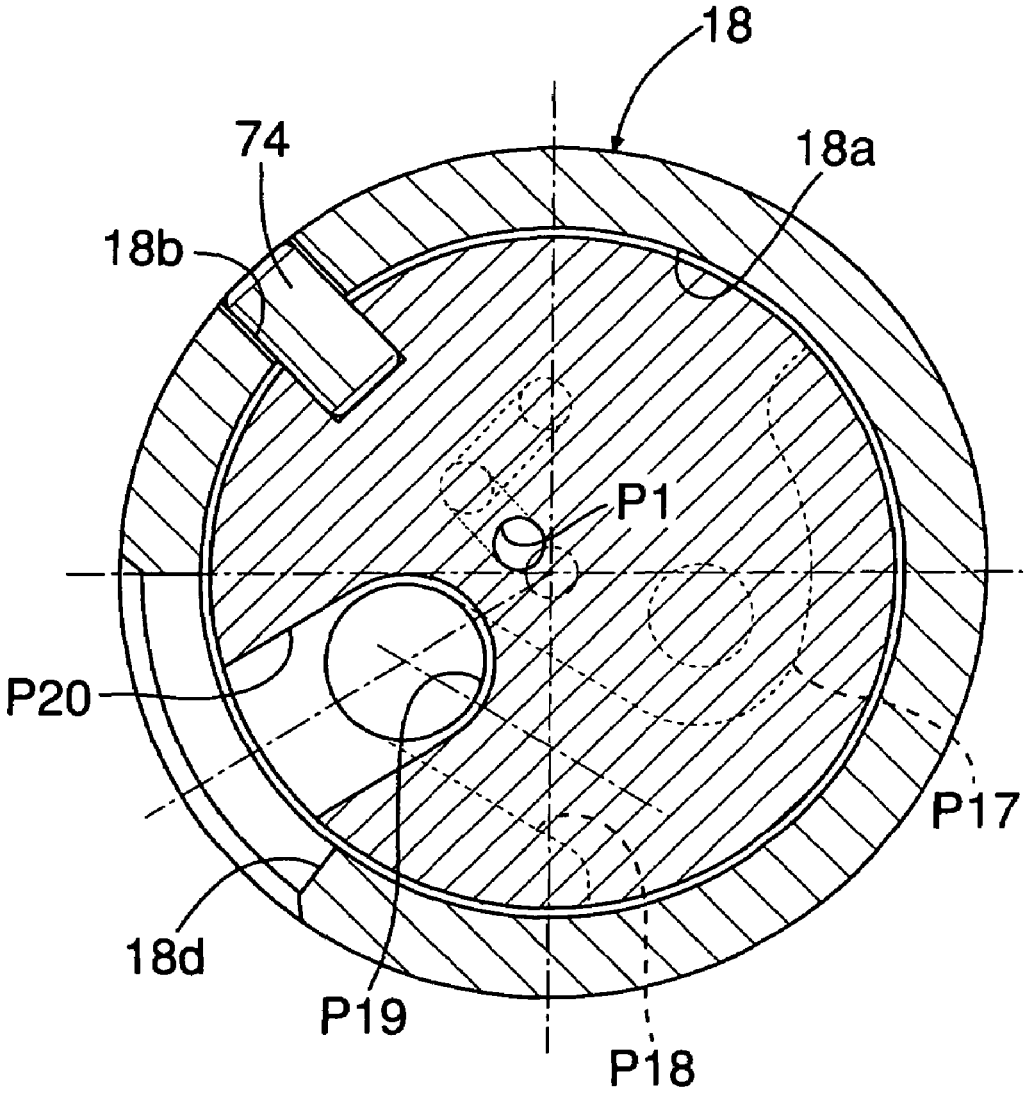
Figure 10:
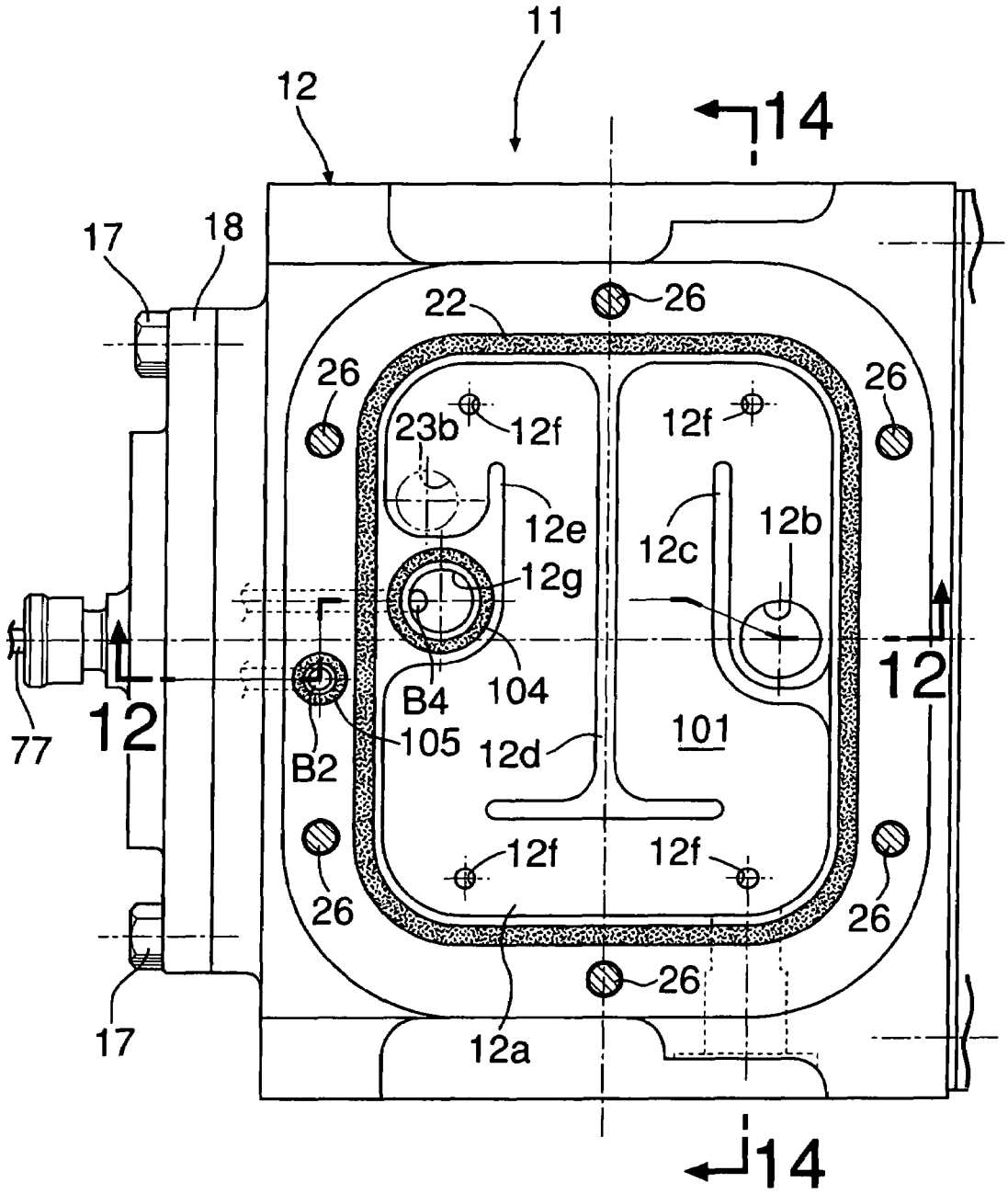
Figure 11:
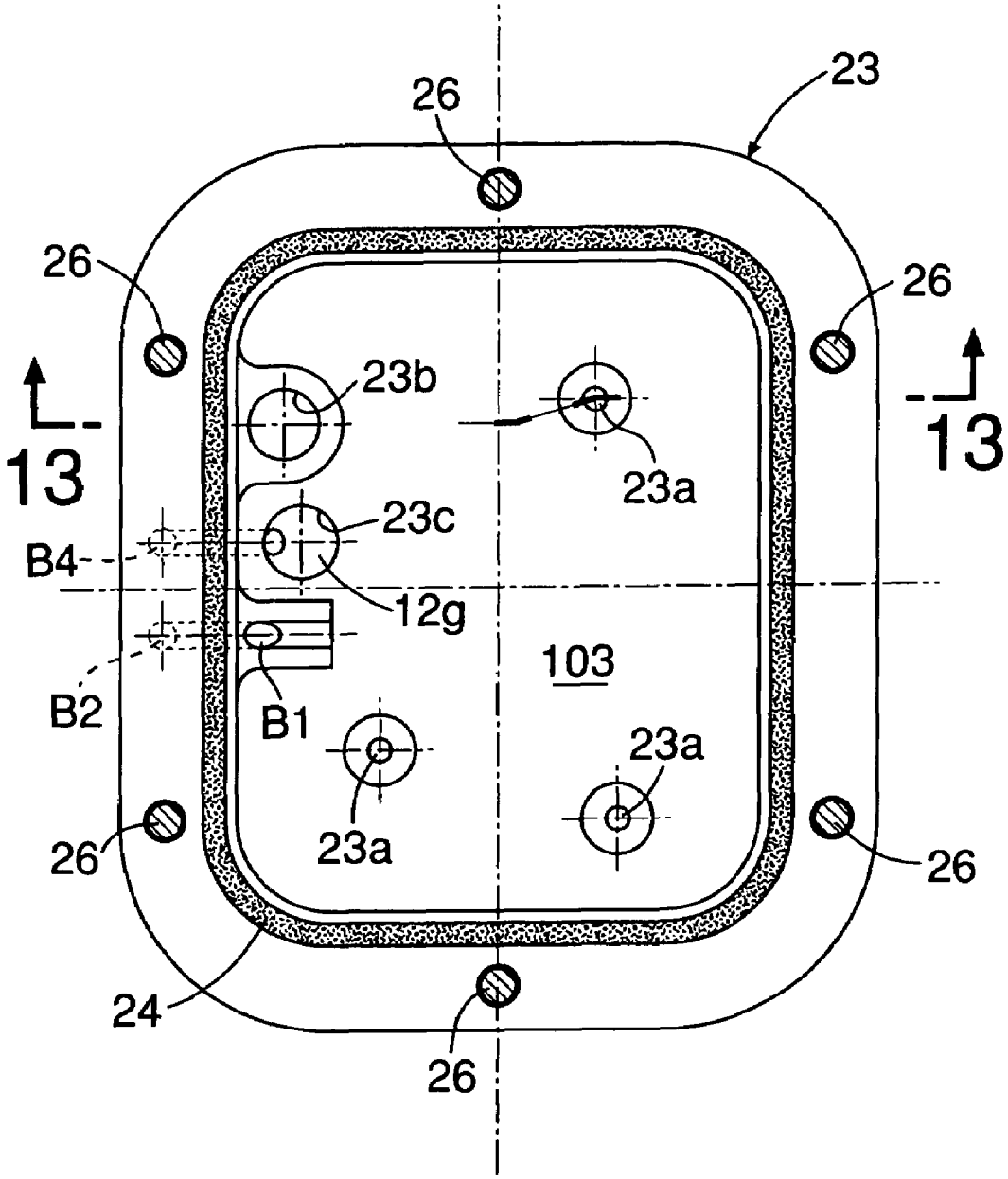
Figure 12:
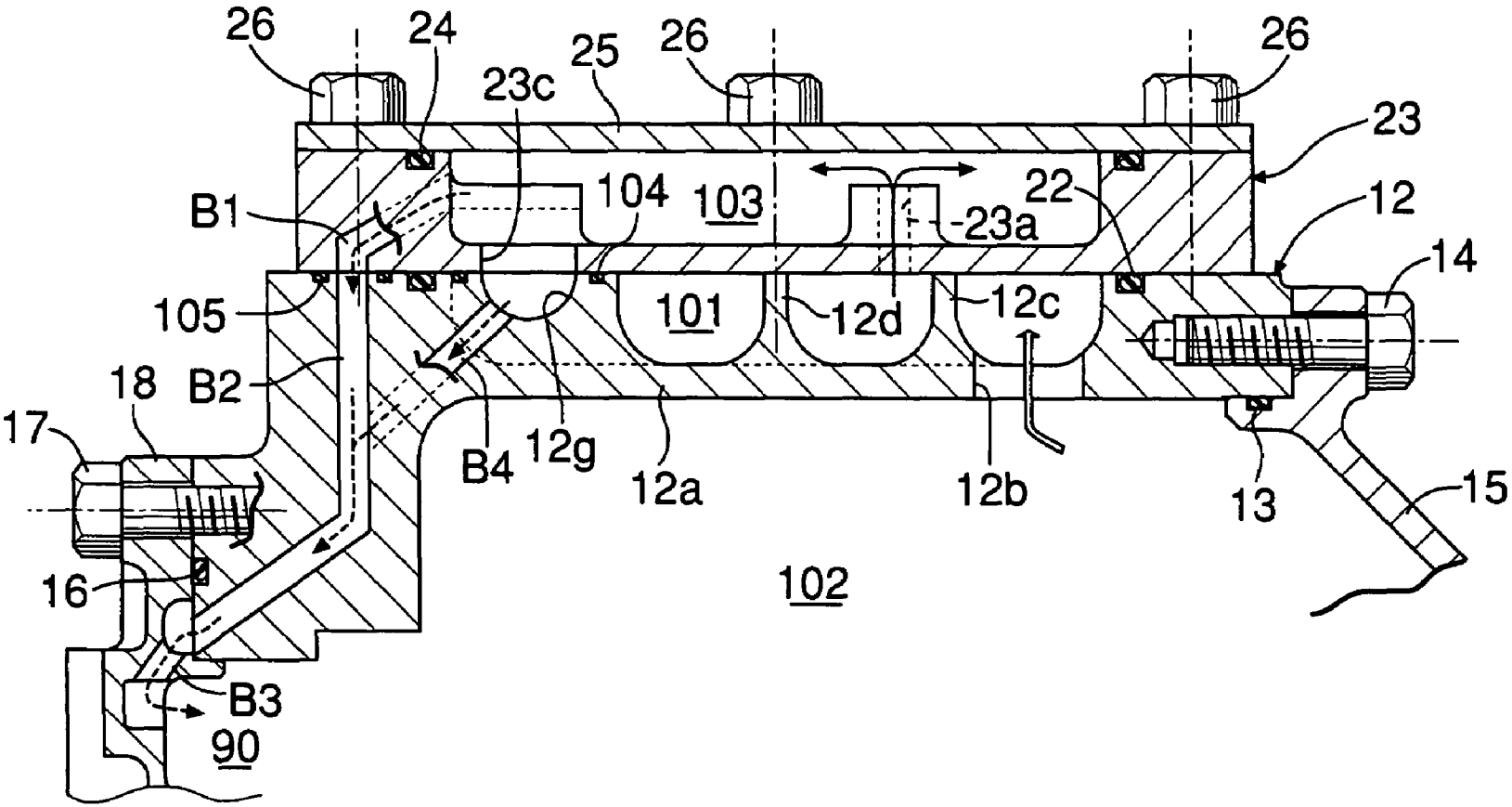
Figure 13:
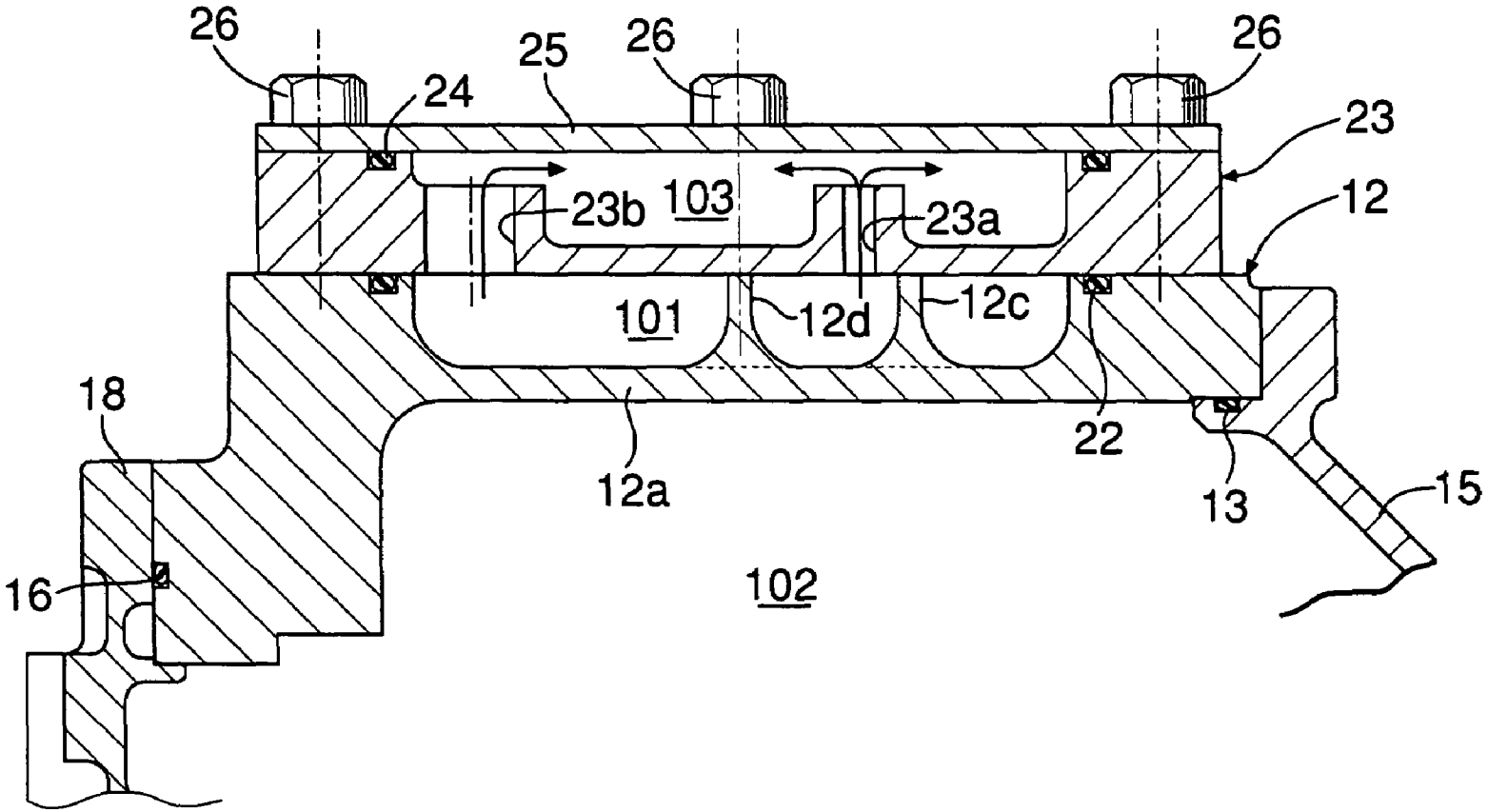
Figure 14:
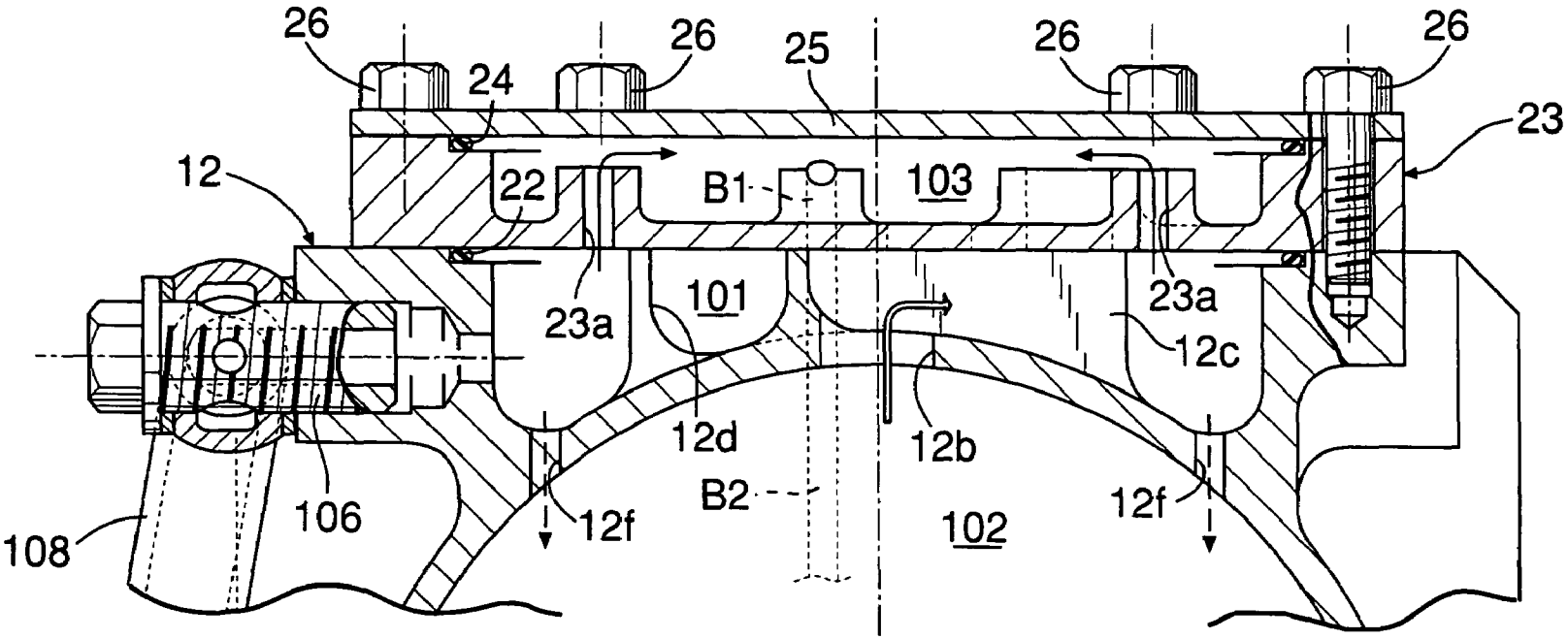

In order to prevent the steam from leaking past the joining surfaces of the rotary valve main body 62 and the stationary valve plate 63, the outer periphery of a part where the sixth and seventh steam passages P6 and P7 are connected is sealed by equipping the joining surfaces with a seal 85 (see FIG. 7 and FIG. 17). Two seals 86 and 87 are disposed between the inner periphery of the sliding member 70 and the rotary valve main body 62, and a seal 88 is disposed between the outer periphery of the coupling member 83 and the sliding member 70.

The interiors of the rotor 27 and the output shaft 28 are hollowed out to define a pressure regulating chamber 89, and this pressure regulating chamber 89 communicates with the eighth steam passage P8 via a twelfth steam passage P12 and a thirteenth steam passage P13 formed in the rotary valve main body 62, a fourteenth steam passage P14 formed in the stationary valve plate 63, and a fifteenth steam passage P15 running through the interior of the bolt 67. The pressure of the medium-temperature, medium-pressure steam discharged from the seven third steam passages P3 into the fifth steam passage P5 pulsates seven times per rotation of the rotor 27, but since the eighth steam passage P8, which is partway along the supply of the medium-temperature, medium-pressure steam to the second group of axial piston cylinders 57, is connected to the pressure regulating chamber 89, the pressure pulsations are dampened, steam at a constant pressure is supplied to the second group of axial piston cylinders 57, and the efficiency with which the low-pressure operating chambers 84 are charged with the steam can be enhanced.

Since the pressure regulating chamber 89 is formed by utilizing dead spaces in the centers of the rotor 27 and the output shaft 28, the dimensions of the expander M are not increased, the hollowing out brings about a weight reduction effect and, moreover, since the outer periphery of the pressure regulating chamber 89 is surrounded by the first group of axial piston cylinders 49, which are operated by the high-temperature, high-pressure steam, there is no resultant heat loss in the medium-temperature, medium-pressure steam supplied to the second group of axial piston cylinders 57. Furthermore, when the temperature of the center of the rotor 27, which is surrounded by the first group of axial piston cylinders 49, increases, the rotor 27 can be cooled by the medium-temperature, medium-pressure steam in the pressure regulating chamber 89, and the resulting heated medium-temperature, medium-pressure steam enables the output of the second group of axial piston cylinders 57 to be increased.

Figure 18:
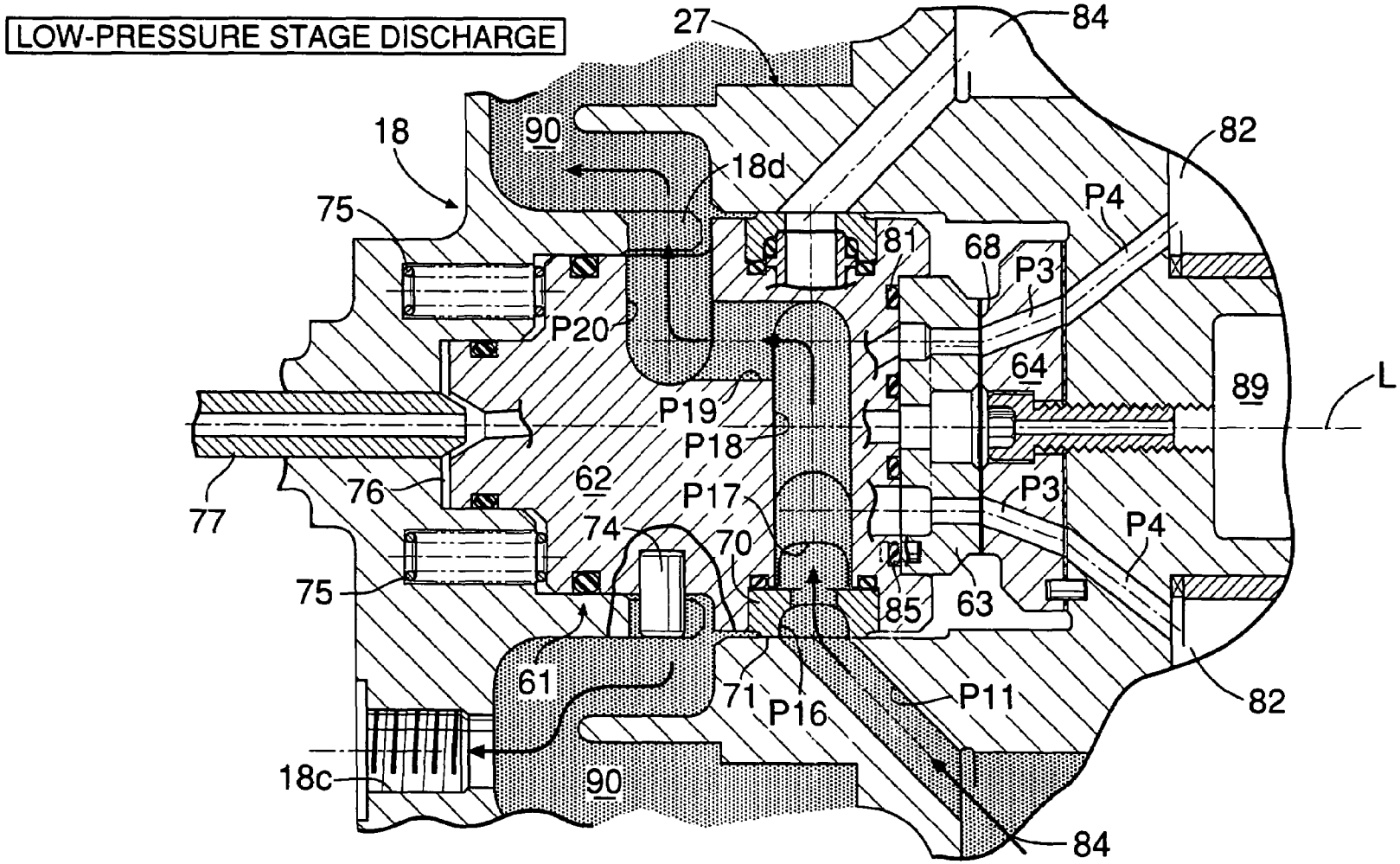

A steam discharge route for discharging the low-temperature, low-pressure steam from the second group of axial piston cylinders 57 is shown in FIG. 18 by a mesh pattern. As is clear from reference to FIG. 18 together with FIG. 8, and FIG. 9, an arc-shaped sixteenth steam passage P16 that can communicate with the seven eleventh steam passages P11 formed in the rotor 27 is cut out in the sliding surface 71 of the sliding member 70. This sixteenth steam passage P16 communicates with a seventeenth steam passage. P17 that is cut out in an arc-shape in the outer periphery of the rotary valve main body 62. The sixteenth steam passage P16 opens from a position displaced slightly forward in the direction of rotation of the rotor 27, which is shown by the arrow R, relative to the BDC of the low-pressure pistons 51 to a position rotationally slightly backward relative to the TDC. This allows the eleventh steam passages P11 of the rotor 27 to communicate with the sixteenth steam passage P16 of the sliding member 70 over an angular range that starts from the BDC and does not overlap the tenth steam passage P10 (preferably, immediately before overlapping the tenth steam passage P10), and in this range the steam is discharged from the eleventh steam passages P11 to the sixteenth steam passage P16.

The seventeenth steam passage P17 further communicates with a steam discharge chamber 90 formed between the rotary valve main body 62 and the rear cover 18 via an eighteenth steam passage P18 to a twentieth steam passage P20 formed within the rotary valve main body 62 and a cutout 18*d* of the rear cover 18, and this steam discharge chamber 90 communicates with a steam discharge hole 18*c* formed in the rear cover 18.

As hereinbefore described, since the supply and discharge of the steam to and from the first group of axial piston cylinders 49 and the supply and discharge of the steam to and from the second group of axial piston cylinders 57 are controlled by the common rotary valve 61, in comparison with a case in which separate rotary valves are used for each, the dimensions of the expander M can be reduced. Moreover, since a valve for supplying the high-temperature, high-pressure steam to the first group of axial piston cylinders 49 is formed on the flat sliding surface 68 on the front end of the stationary valve plate 63, which is integral with the rotary valve main body 62, it is possible to prevent effectively the high-temperature, high-pressure steam from leaking. This is because the flat sliding surface 68 can be machined easily with high precision, and control of clearance is easier than for a cylindrical sliding surface.

In particular, since the plurality of preload springs 75 apply a preset load to the rotary valve main body 62 and bias it forward in the axis L direction, and the high-temperature, high-pressure steam supplied from the steam supply pipe 77 to the pressure chamber 76 biases the rotary valve main body 62 forward in the axis L direction, a surface pressure is generated on the sliding surface 68 between the stationary valve plate 63 and the movable valve plate 64 in response to the pressure of the high-temperature, high-pressure steam, and it is thus possible to prevent yet more effectively the steam from leaking past the sliding surface 68.

Although a valve for supplying the medium-temperature, medium-pressure steam to the second group of axial piston cylinders 57 is formed on the cylindrical sliding surface 71 on the outer periphery of the rotary valve main body 62, since the pressure of the medium-temperature, medium-pressure steam passing through the valve is lower than the pressure of the high-temperature, high-pressure steam, the leakage of the steam can be suppressed to a practically acceptable level by maintaining a predetermined clearance without generating a surface pressure on the sliding surface 71.

Furthermore, since the first steam passage P1 through which the high-temperature, high-pressure steam passes, the seventh steam passage P7 and the eighth steam passage P8 through which the medium-temperature, medium-pressure steam passes, and the seventeenth steam passage P17 to the twentieth steam passage P20 through which the low-temperature, low-pressure steam passes are collectively formed within the rotary valve main body 62, not only can the steam temperature be prevented from dropping, but also the parts (for example, the seal 81) sealing the high-temperature, high-pressure steam can be cooled by the low-temperature, low-pressure steam, thus improving the durability.

Moreover, since the rotary valve 61 can be attached to and detached from the casing main body 12 merely by removing the rear cover 18 from the casing main body 12, the ease of maintenance operations such as repair, cleaning, and replacement can be greatly improved. Furthermore, although the temperature of the rotary valve 61 through which the high-temperature, high-pressure steam passes becomes high, since the swash plate 39 and the output shaft 28, where lubrication by oil is required, are disposed on the opposite side to the rotary valve 61 relative to the rotor 27, the oil is prevented from being heated by the heat of the rotary valve 61 when it is at high temperature, which would degrade the performance in lubricating the swash plate 39 and the output shaft 28. Moreover, the oil can exhibit a function of cooling the rotary valve 61, thus preventing overheating.

The structure of a breather is now explained by reference to FIG. 10 to FIG. 14.

A lower breather chamber 101 defined between an upper wall 12*a* of the casing main body 12 and the breather chamber dividing wall 23 communicates with a lubrication chamber 102 within the casing 11 via a through hole 12*b* formed in the upper wall 12*a* of the casing main body 12. Oil is stored in the oil pan 19 provided in a bottom part of the lubrication chamber 102, and the oil level is slightly higher than the lower end of the rotor 27 (see FIG. 1). Provided within the lower breather chamber 101 so as to project upward are three dividing walls 12*c* to 12*e* having their upper ends in contact with a lower surface of the breather chamber dividing wall 23. The through hole 12*b* opens at one end of a labyrinth formed by these dividing walls 12*c* to 12*e*, and four oil return holes 12*f* running through the upper wall 12*a* are formed partway along the route to the other end of the labyrinth. The oil return holes 12*f* are formed at the lowest position of the lower breather chamber 101 (see FIG. 14), and the oil condensed within the lower breather chamber 101 can therefore be reliably returned to the lubrication chamber 102.

An upper breather chamber 103 is defined between the breather chamber dividing wall 23 and the breather chamber cover 25, and this upper breather chamber 103 communicates with the lower breather chamber 101 via four through holes 23*a* and 23*b* running through the breather chamber dividing wall 23 and projecting in a chimney-shape within the upper breather chamber 103. A recess 12*g* is formed in the upper wall 12*a* of the casing main body 12 at a position below a condensed water return hole 23*c* running through the breather chamber dividing wall 23, and the periphery of the recess 12*g* is sealed by a seal 104.

One end of a first breather passage B1 formed in the breather chamber dividing wall 23 opens at mid height in the upper breather chamber 103. The other end of the first breather passage B1 communicates with the steam discharge chamber 90 via a second breather passage B2 formed in the casing main body 12 and a third breather passage B3 formed in the rear cover 18. Furthermore, the recess 12*g*, which is formed in the upper wall 12*a*, communicates with the steam discharge chamber 90 via a fourth breather passage B4 formed in the casing main body 12 and the third breather passage B3. The outer periphery of a part providing communication between the first breather passage B1 and the second breather passage B2 is sealed by a seal 105.

As shown in FIG. 2, a coupling 106 communicating with the lower breather chamber 101 and a coupling 107 communicating with the oil pan 19 are connected together by a transparent oil level gauge 108, and the oil level within the lubrication chamber 102 can be checked from the outside by the oil level of this oil level gauge 108. That is, the lubrication chamber 102 has a sealed structure, it is difficult to insert an oil level gauge from the outside from the viewpoint of maintaining sealing characteristics, and the structure will inevitably become complicated. However, this oil level gauge 108 enables the oil level to be checked easily from the outside while maintaining the lubrication chamber 102 in a sealed state.

The operation of the expander M of the present embodiment having the above-mentioned arrangement is now explained.

As shown in FIG. 16, high-temperature, high-pressure steam generated by heating water in an evaporator is supplied to the pressure chamber 76 of the expander M via the steam supply pipe 77, and reaches the sliding surface 68 with the movable valve plate 64 via the first steam passage P1 formed in the rotary valve main body 62 of the rotary valve 61 and the second steam passage P2 formed in the stationary valve plate 63 integral with the rotary valve main body 62. The second steam passage P2 opening on the sliding surface 68 communicates momentarily with the third steam passages P3 formed in the movable valve plate 64 rotating integrally with the rotor 27, and the high-temperature, high-pressure steam is supplied, via the fourth steam passage P4 formed in the rotor 27, from the third steam passages P3 to, among the seven high-pressure operating chambers 82 of the first group of axial piston cylinders 49, the high-pressure operating chamber 82 that is present at the top dead, center.

Even after the communication between the second steam passage P2 and the third steam passages P3 has been blocked due to rotation of the rotor 27, the high-temperature, high-pressure steam expands within the high-pressure operating chamber 82 and causes the high-pressure piston 43 fitted in the high-pressure cylinder 42 of the sleeve 41 to be pushed forward from top dead center toward bottom dead center, and the front end of the high-pressure piston 43 presses against the dimple 39*a* of the swash plate 39. As a result, the reaction force that the high-pressure pistons 43 receive from the swash plate 39 gives a rotational torque to the rotor 27. For each one seventh of a revolution of the rotor 27, the high-temperature, high-pressure steam is supplied into a fresh high-pressure operating chamber 82, thus continuously rotating the rotor 27.

As shown in FIG. 17, while the high-pressure piston 43, having reached bottom dead center accompanying rotation of the rotor 27, retreats toward top dead center, the medium-temperature, medium-pressure steam pushed out of the high-pressure operating chamber 82 is supplied to the eleventh steam passage P11 communicating with the low-pressure operating chamber 84 that, among the second group of axial piston cylinders 57, has reached top dead center accompanying rotation of the rotor 27, via the fourth steam passage P4 of the rotor 27, the third steam passage P3 of the movable valve plate 64, the sliding surface 68, the fifth steam passage P5 and the sixth steam passage P6 of the stationary valve plate 63, the seventh steam passage P7 to the tenth steam passage P10 of the rotary valve main body 62, and the sliding surface 71. Since the medium-temperature, medium-pressure steam supplied to the low-pressure operating chamber 84 expands within the low-pressure operating chambers 84 even after the communication between the tenth steam passage P10 and the eleventh steam passage P11 is blocked, the low-pressure piston 51 fitted in the low-pressure cylinder 50 is pushed forward from top dead center toward bottom dead center, and the link 52 connected to the low-pressure piston 51 presses against the swash plate 39. As a result, the pressure force of the low-pressure piston 51 is converted into a rotational force of the swash plate 39 via the link 52, and this rotational force transmits a rotational torque from the high-pressure piston 43 to the rotor 27 via the dimple 39*a* of the swash plate 39. That is, the rotational torque is transmitted to the rotor 27, which rotates synchronously with the swash plate 39. In order to prevent the low-pressure piston 51 from becoming detached from the swash plate 39 when a negative pressure is generated during the expansion stroke, the link 52 carries out a function of maintaining a connection between the low-pressure piston 51 and the swash plate 39, and it is arranged that the rotational torque due to the expansion is transmitted from the high-pressure piston 43 to the rotor 27 rotating synchronously with the swash plate 39 via the dimples 39*a* of the swash plate 39 as described above. For each one seventh of a revolution of the rotor 27, the medium-temperature, medium-pressure steam is supplied into a fresh low-pressure operating chamber 84, thus continuously rotating the rotor 27.

During this process, as described above, the pressure of the medium-temperature, medium-pressure steam discharged from the high-pressure operating chambers 82 of the first group of axial piston cylinders 49 pulsates seven times for each revolution of the rotor 27, but by damping these pulsations by the pressure regulating chamber 89 steam at a constant pressure can be supplied to the second group of axial piston cylinders 57, thereby enhancing the efficiency with which the low-pressure operating chambers 84 are charged with the steam.

As shown in FIG. 18, while the low-pressure piston 51, having reached bottom dead center accompanying rotation of the rotor 27, retreats toward top dead center, the low-temperature, low-pressure steam pushed out of the low-pressure operating chamber 84 is discharged into the steam discharge chamber 90 via the eleventh steam passage P11 of the rotor 27, the sliding surface 71, the sixteenth steam passage P16 of the sliding member 70, and the seventeenth steam passage P17 to the twentieth steam passage P20 of the rotary valve main body 62, and supplied therefrom into a condenser via the steam discharge hole 18*c*.

Figure 15:
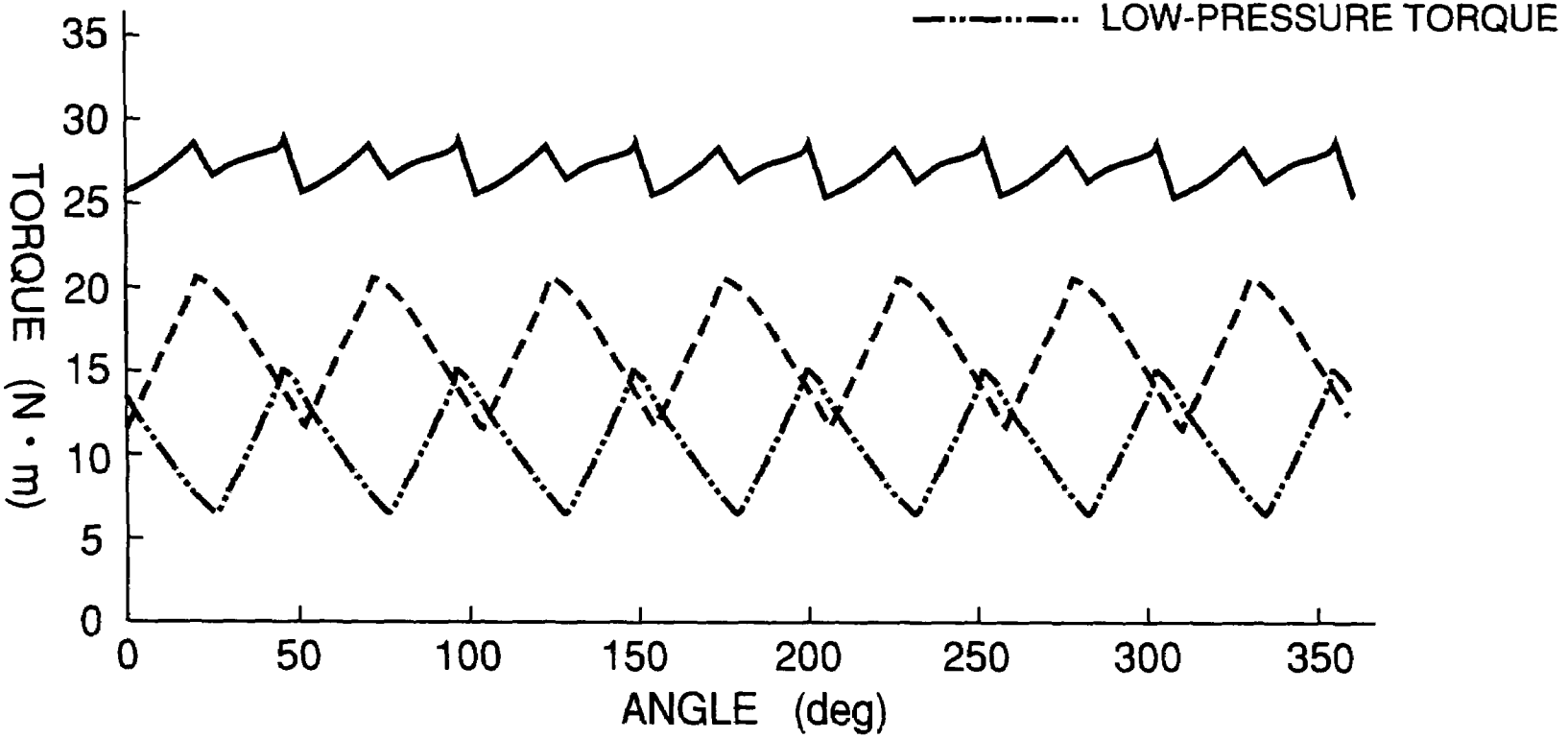

When the expander M operates as described above, since the seven high-pressure pistons 43 of the first group of axial piston cylinders 49 and the seven low-pressure pistons 51 of the second group of axial piston cylinders 57 are connected to the common swash plate 39, the outputs of the first and second groups of axial piston cylinders 49 and 57 can be combined to drive the output shaft 28, thereby achieving a high output while reducing the size of the expander M. During this process, since the seven high-pressure pistons 43 of the first group of axial piston cylinders 49 and the seven low pressure pistons 51 of the second group of axial piston cylinders 57 are displaced by half a pitch in the circumferential direction, as shown in FIG. 15, pulsations in the output torque of the first group of axial piston cylinders 49 and pulsations in the output torque of the second group of axial piston cylinders 57 are counterbalanced, thus making the output torque of the output shaft 28 flat.

Furthermore, although axial type expanders characteristically have a high space efficiency compared with radial type expanders, by arranging two stages in the radial direction the space efficiency can be further enhanced. In particular, since the first group of axial piston cylinders 49, which are required to have only a small diameter because they are operated by high-pressure steam having a small volume, are arranged on the radially inner side, and the second group of axial piston cylinders 57, which are required to have a large diameter because they are operated by low-pressure steam having a large volume, are arranged on the radially outer side, the space can be utilized effectively, thus making the expander M still smaller. Moreover, since the cylinders 42 and 50 and the pistons 43 and 51 that are used have circular cross sections, which enables machining to be carried out with high precision, the amount of steam leakage can be reduced in comparison with a case in which vanes are used, and a yet higher output can thus be anticipated.

Furthermore, since the first group of axial piston cylinders 49 operated by high-temperature steam are arranged on the radially inner side, and the second group of axial piston cylinders 57 operated by low-temperature steam are arranged on the radially outer side, the difference in temperature between the second group of axial piston cylinders 57 and the outside of the casing 11 can be minimized, the amount of heat released outside the casing 11 can be minimized, and the efficiency of the expander M can be enhanced. Moreover, since the heat escaping from the high-temperature first group of axial piston cylinders 49 on the radially inner side can be recovered by the low-temperature second group of axial piston cylinders 57 on the radially outer side, the efficiency of the expander M can be further enhanced.

Moreover, when viewed from an angle perpendicular to the axis L, since the rear end of the first group of axial piston cylinders 49 is positioned forward relative to the rear end of the second group of axial piston cylinders 57, the heat escaping rearward in the axis L direction from the first group of axial piston cylinders 49 can be recovered by the second group of axial piston cylinders 57, and the efficiency of the expander M can be yet further enhanced. Furthermore, since the sliding surface 68 on the high-pressure side is present deeper within the recess 27*b* of the rotor 27 than the sliding surface 71 on the low-pressure side, the difference in pressure between the outside of the casing 11 and the sliding surface 71 on the low-pressure side can be minimized, the amount of leakage of steam from the sliding surface 71 on the low-pressure side can be reduced and, moreover, the pressure of steam leaking from the sliding surface 68 on the high-pressure side can be recovered by the sliding surface 71 on the low-pressure side and utilized effectively.

During operation of the expander M, the oil stored in the oil pan 19 is stirred and splashed by the rotor 27 rotating within the lubrication chamber 102 of the casing 11, thereby lubricating a sliding section between the high-pressure cylinders 42 and the high-pressure pistons 43, a sliding section between the low-pressure cylinders 50 and the low-pressure pistons 51, the angular ball bearing 31 supporting the output shaft 28, the angular ball bearing 29 supporting the rotor 27, the angular ball bearing 38 supporting the swash plate 39, a sliding section between the high-pressure pistons 43 and the swash plate 39, the spherical bearings 54 and 56 at opposite ends of the links 52, etc.

The interior of the lubrication chamber 102 is filled with oil mist generated by splashing due to stirring of the oil, and oil vapor generated by vaporization due to heating by a high-temperature section of the rotor 27, and this is mixed with steam leaking into the lubrication chamber 102 from the high-pressure operating chambers 82 and low-pressure operating chambers 84. When the pressure of the lubrication chamber 102 becomes higher than the pressure of the steam discharge chamber 90 due to leakage of the steam, the mixture of oil content and steam flows through the through hole 12*b* formed in the upper wall 12*a* of the casing main body 12 into the lower breather chamber 101. The interior of the lower breather chamber 101 has a labyrinth structure due to the dividing walls 12*c* to 12*e*; the oil that condenses while passing therethrough drops through the four oil return holes 12*f* formed in the upper wall 12*a* of the casing main body 12, and is returned to the lubrication chamber 102.

The steam from which the oil content has been removed passes through the four through holes 23*a* and 23*b* of the breather chamber dividing wall 23, flows into the upper breather chamber 103, and condenses by losing its heat to the outside air via the breather chamber cover 25, which defines an upper wall of the upper breather chamber 103. Water that has condensed within the upper breather chamber 103 passes through the condensed water return hole 23*c* formed in the breather chamber dividing wall 23 and drops into the recess 12*g* without flowing into the four through holes 23*a*, 23*b* projecting in a chimney-shape within the upper breather chamber 103, and is discharged therefrom into the steam discharge chamber 90 via the fourth breather passage B4 and the third breather passage B3. Here, the amount of condensed water returned into the steam discharge chamber 90 corresponds to the amount of steam that has leaked from the high-pressure operating chambers 82 and the low-pressure operating chambers 84 into the lubrication chamber 102. Furthermore, since the steam discharge chamber 90 and the upper breather chamber 103 always communicate with each other via the first steam passage B1 to the third steam passage B3, which function as pressure equilibration passages, pressure equilibrium between the steam discharge chamber 90 and the lubrication chamber 102 can be maintained.

During a transition period prior to completion of warming-up, if the pressure of the lubrication chamber 102 becomes lower than the pressure of the steam discharge chamber 90, the steam in the steam discharge chamber 90 might be expected to flow into the lubrication chamber 102 via the third breather passage B3, the second breather passage B2, the first breather passage B1, the upper breather chamber 103, and the lower breather chamber 101, but after completion of the warming-up, because of the leakage of steam into the lubrication chamber 102, the pressure of the lubrication chamber 102 becomes higher than the pressure of the steam discharge chamber 90, and the above-mentioned oil and steam separation is started.

In a Rankine cycle system in which steam (or water), which is the working medium, circulates in a closed circuit formed from an evaporator, an expander, a condenser, and a circulation pump, it is necessary to avoid as much as possible the oil from being mixed with the working medium and contaminating the system; the mixing of the oil with the steam (or water) can be minimized by the lower breather chamber 101 separating the oil and the upper breather chamber 103 separating the condensed water, thus reducing the load imposed on a filter separating the oil, achieving a reduced size and a reduction in cost, and thereby preventing contamination and degradation of the oil.

The second embodiment of the present invention is now explained by reference to FIG. 19.

Figure 6:
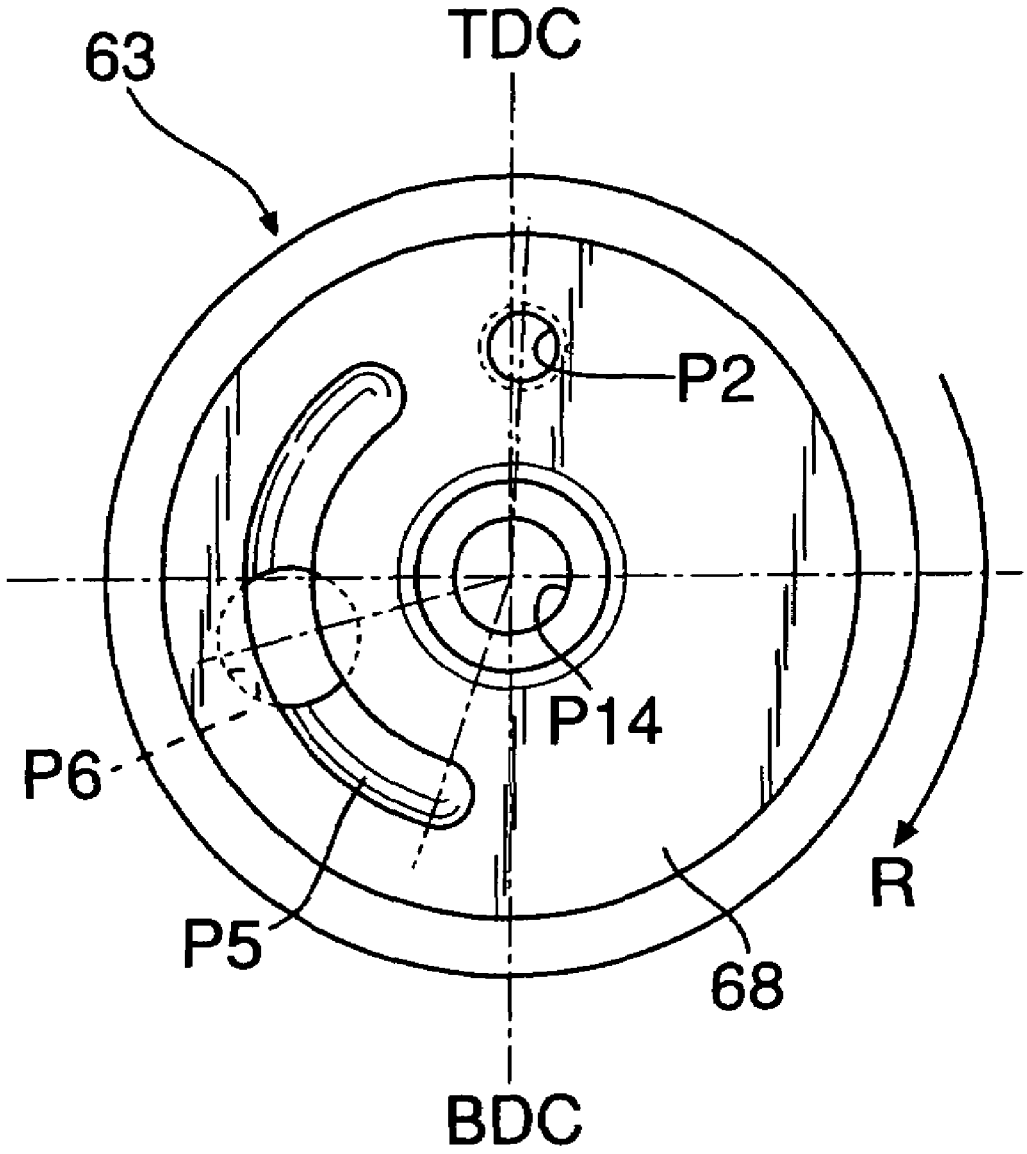
Figure 19:
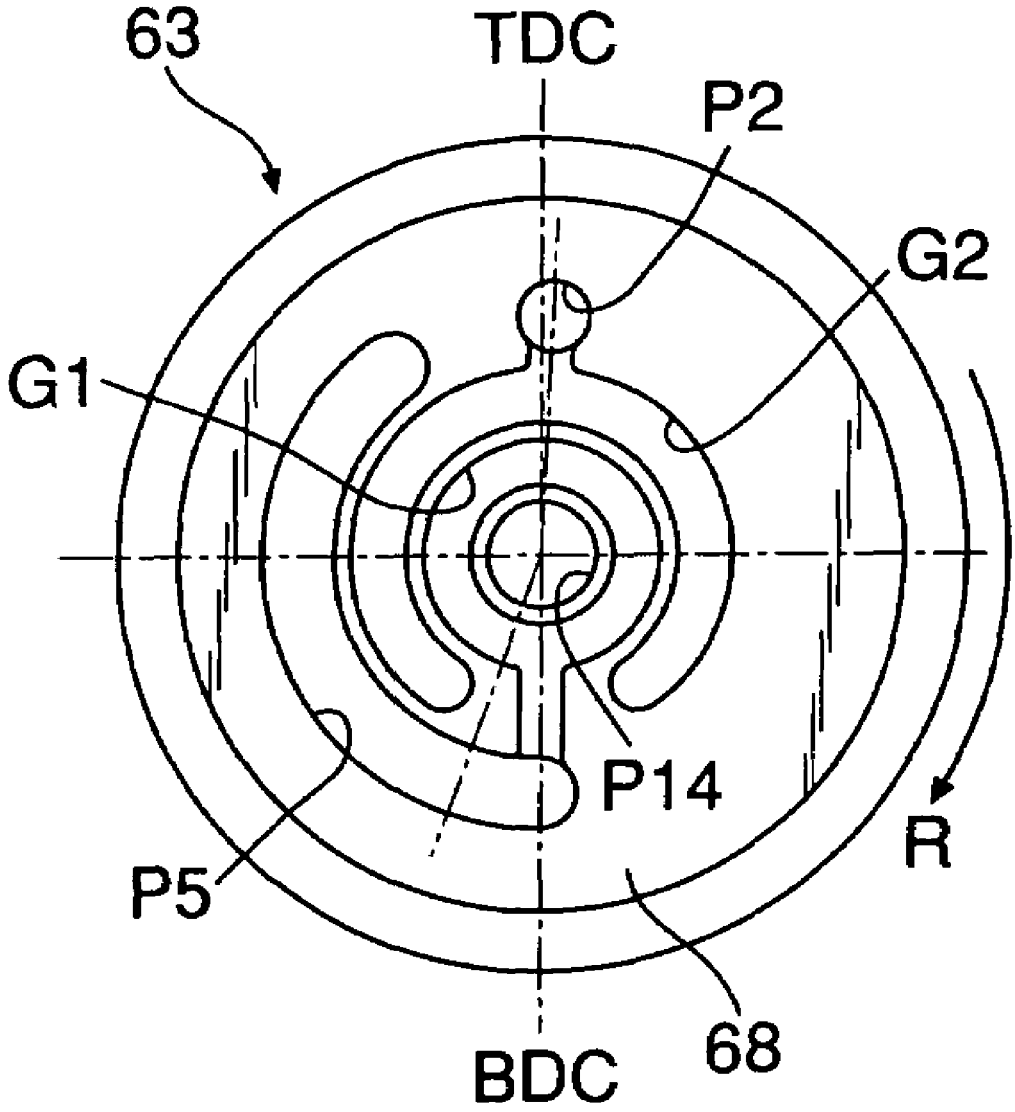
FIG. 19 corresponds to FIG. 6 and illustrates a second embodiment of the present invention.

FIG. 19 shows a sliding surface 68 of a stationary valve plate 63 and corresponds to FIG. 6, which shows the first embodiment. The resilient force of preset springs 75 and the pressure of high-temperature, high-pressure steam acting on a pressure chamber 76 give a sealing surface pressure to the sliding surface 68, but it is difficult to secure a uniform sealing surface pressure over the entire area of the sliding surface 68. This is because the high-temperature, high-pressure steam is supplied to a second steam passage P2 and third steam passages P3 passing through the sliding surface 68, and this high-temperature, high-pressure steam acts to detach the stationary valve plate 63 from a movable valve plate 64 and thereby reduce the sealing surface pressure. On the other hand, medium-temperature, medium-pressure steam is supplied to a fifth steam passage P5 and the third steam passages P3 running through the sliding surface 68, and since the pressure thereof is lower than the pressure of the high-temperature, high-pressure steam, its action of detaching the sliding surface 68 and thereby reducing the sealing surface pressure is also small. As a result, the steam pressures of the second steam passage P2, the third steam passages P3, and the fifth steam passage P5 apply an imbalanced load to the sliding surface 68, thus causing the sealing performance of the sliding surface 68 to deteriorate.

In the present second embodiment, an annular first pressure channel G1 is machined in the sliding surface 68 of the stationary valve plate 63 so as to surround the outer periphery of a fourteenth steam passage P14 passing along the axis L, the first pressure channel G1 being made to communicate with the fifth steam passage P5 through which the medium-temperature, medium-pressure steam passes, and an arc-shaped second pressure channel G2 is machined so as to surround the outer periphery of the first pressure channel G1, the second pressure channel G2 being made to communicate with the second steam passage P2 through which the high-temperature, high-pressure steam passes. The actions of the first and second pressure channels G1 and G2 ease the uneven sealing surface pressure on the sliding surface 68, and deterioration of the sealing characteristics and generation of friction due to uneven contact with the sliding surface 68 can be prevented. Furthermore, when the steam leaking from the high-pressure second pressure channel G2 flows into the low-pressure first pressure channel G1, an abrasive powder is discharged into the first pressure channel G1, and an effect of preventing it from flowing into the high-pressure operating chambers 82 is thus exhibited. Moreover, the steam is uniformly distributed on the sliding surface 68, where lubrication by oil cannot be expected, thereby improving the lubrication performance.

Figure 20:
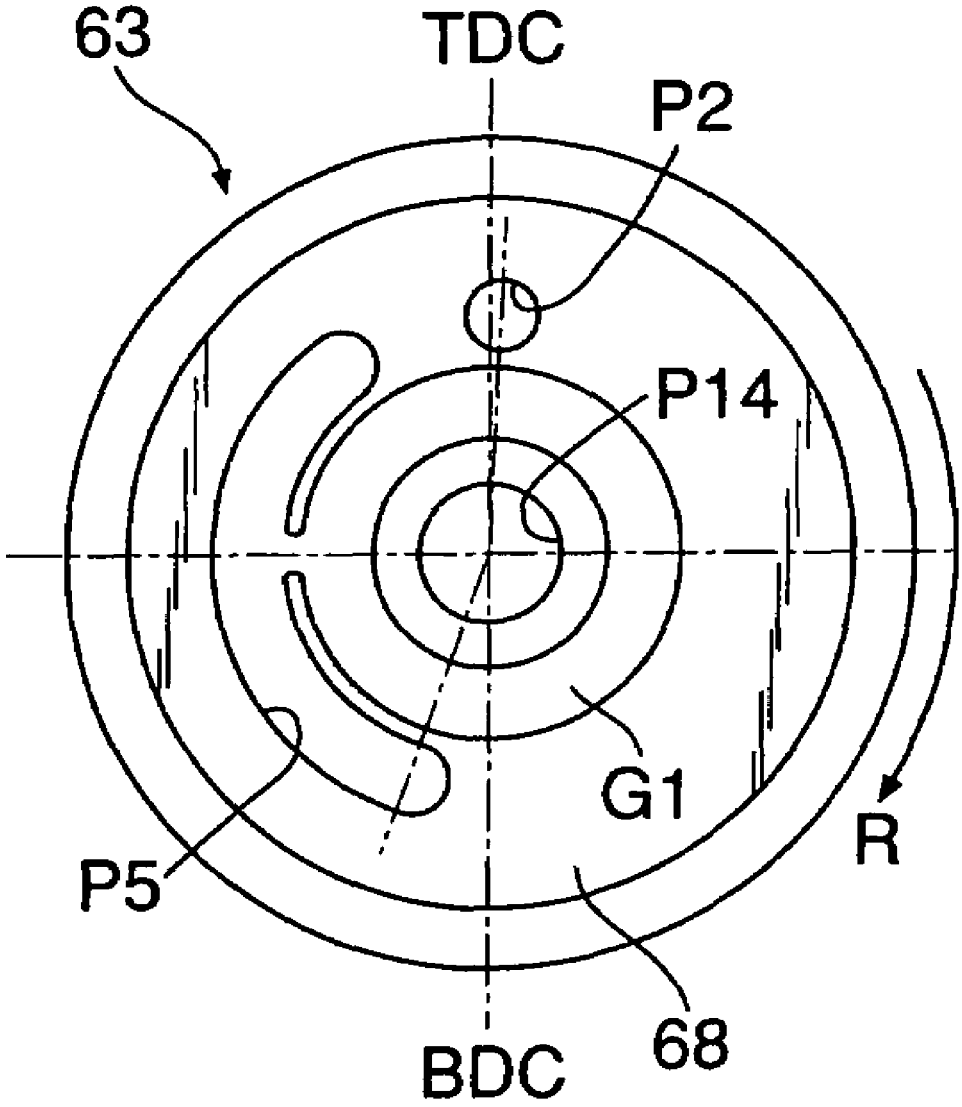
FIG. 20 corresponds to FIG. 6 and illustrates a third embodiment of the present invention.

The third embodiment of the present invention is now explained by reference to FIG. 20.

The third embodiment is a modification of the second embodiment; a second pressure channel G2 communicating with a second steam passage P2 through which high-temperature, high-pressure steam passes is omitted, and only a first pressure channel G1 communicating with a fifth steam passage P5 through which medium-temperature, medium-pressure steam passes is provided. In accordance with the present third embodiment, not only does the structure become simple compared with the second embodiment, but also the effect of recovering abrasive powder can be enhanced and, moreover, the amount of leakage of steam can be reduced in comparison with the second embodiment.

Although embodiments of the present invention are explained above, the present invention can be modified in a variety of ways without departing from the spirit and scope thereof.

For example, in the embodiments the first group of axial piston cylinders 49 and the second group of axial piston cylinders 57 are provided, but three or more sets of groups of axial piston cylinders may be provided.

INDUSTRIAL APPLICABILITY

As hereinbefore described, the expander related to the present invention can be applied desirably to a Rankine cycle system, but it can be applied to any purpose and is not limited to the Rankine cycle system.

What is claimed is:

1. An expander comprising a casing;

an output shaft for outputting a driving force;

a rotor integral with the output shaft and rotatably supported in the casing;

a plurality of groups of axial piston cylinders arranged annularly in the rotor along the radial direction so as to surround an axis (L) of the output shaft; and a common swash plate fixed to the casing and guiding pistons of the plurality of groups of axial piston cylinders in the direction of the axis (L);

wherein the more radially outwardly positioned the pistons of the plurality of groups of axial piston cylinders the larger the diameter; and a high-temperature, high-pressure working medium prior to expansion is supplied to group of radially inner axial piston cylinders, and a low-temperature, low-pressure working medium subsequent to expansion, which is the working medium discharged from the group of radially inner axial piston cylinders, is supplied to the group of radially outer axial piston cylinders, wherein the supply and discharge of the working mediums to and from the group of radially inner axial piston cylinders as well as to and from the group of radially outer axial piston cylinders are controlled by a common rotary valve through seals, wherein the rotary valve is housed in circular cross section recess opening on an end surface of the rotor wherein the rotary valve is connected to the radially outer axial piston cylinders by a first passage extending through a circumferential cylindrical sliding surface of the rotary valve, whereas the rotary valve is connected to the radially inner axial piston cylinders by a second passage (P3, P4) extending through a flat sliding surface of the rotary valve extending normal to the axis (L).

2. The expander according to claim 1, wherein the pitches at which radially adjacent groups of axial piston cylinders are arranged are displaced circumferentially.

3. The expander according to claim 1, wherein a working medium supply/discharge part formed from the common rotary valve for supplying and discharging the working medium to and from the plurality of groups of axial piston cylinders, a power conversion part formed from the rotor, and an output part formed form the output shaft and the swash are arranged sequentially from one end of the axis (L) to the other end thereof.

* * * * *